US007534951B2

(12) United States Patent
Yamashita

(10) Patent No.: US 7,534,951 B2
(45) Date of Patent: May 19, 2009

(54) BEAT EXTRACTION APPARATUS AND METHOD, MUSIC-SYNCHRONIZED IMAGE DISPLAY APPARATUS AND METHOD, TEMPO VALUE DETECTION APPARATUS, RHYTHM TRACKING APPARATUS AND METHOD, AND MUSIC-SYNCHRONIZED DISPLAY APPARATUS AND METHOD

(75) Inventor: Kosei Yamashita, Kanagawa (JP)

(73) Assignee: Sony Corporation, Tokyo (JP)

( * ) Notice: Subject to any disclaimer, the term of this patent is extended or adjusted under 35 U.S.C. 154(b) by 254 days.

(21) Appl. No.: 11/486,359

(22) Filed: Jul. 13, 2006

(65) Prior Publication Data

US 2007/0022867 A1 Feb. 1, 2007

(30) Foreign Application Priority Data

Jul. 27, 2005 (JP) ..... 2005-216786

(51) Int. Cl.
*G10H 3/00* (2006.01)

(52) U.S. Cl. ..... 84/611; 84/651; 84/600

(58) Field of Classification Search ..... 84/600–602, 84/611, 651

See application file for complete search history.

(56) References Cited

U.S. PATENT DOCUMENTS

| | | | | |
|---|---|---|---|---|
| 6,542,869 | B1 * | 4/2003 | Foote | 704/500 |
| 7,027,124 | B2 * | 4/2006 | Foote et al. | 352/1 |
| 7,179,982 | B2 * | 2/2007 | Goto | 84/616 |
| 2002/0172372 | A1 * | 11/2002 | Tagawa et al. | 381/56 |
| 2003/0160944 | A1 * | 8/2003 | Foote et al. | 352/1 |
| 2003/0205124 | A1 * | 11/2003 | Foote et al. | 84/608 |
| 2004/0068401 | A1 | 4/2004 | Herre et al. | |
| 2004/0069123 | A1 * | 4/2004 | Becker et al. | 84/612 |
| 2005/0241465 | A1 * | 11/2005 | Goto | 84/616 |
| 2007/0255739 | A1 * | 11/2007 | Miyajima et al. | 707/101 |
| 2007/0276733 | A1 * | 11/2007 | Geshwind et al. | 705/14 |
| 2008/0034948 | A1 * | 2/2008 | Sumita | 84/636 |

FOREIGN PATENT DOCUMENTS

| | | |
|---|---|---|
| JP | 11-212552 | 8/1999 |
| JP | 11-212553 | 8/1999 |
| JP | 3066528 | 5/2000 |
| JP | 2000-267655 | 9/2000 |
| JP | 2002-116754 | 4/2002 |

(Continued)

*Primary Examiner*—David S. Warren
(74) *Attorney, Agent, or Firm*—Wolf, Greenfield & Sacks, P.C.

(57) ABSTRACT

A music-synchronized display apparatus includes a beat extractor configured to detect a portion in which a power spectrum in a spectrogram of an input music signal greatly changes and to output a detection output signal that is synchronized in time to the changing portion in synchronization with the input music signal; a tempo value estimation section configured to detect the self-correlation of the detection output signal from the beat extractor and to estimate a tempo value of the input music signal; a variable frequency oscillator in which an oscillation center frequency is determined on the basis of the tempo value from the tempo value estimation section and the phase of the output oscillation signal is controlled on the basis of a phase control signal; a phase comparator; a beat synchronization signal generation and output section; an attribute information storage section; an attribute information obtaining section; and a display information generator.

11 Claims, 11 Drawing Sheets

FOREIGN PATENT DOCUMENTS

| | | |
|---|---|---|
| JP | 2003-263162 | 9/2003 |
| JP | 2004-233965 | 8/2004 |
| JP | 2004-528596 | 9/2004 |
| JP | 2004-302053 | 10/2004 |
| JP | 2005-122664 | 5/2005 |

* cited by examiner (A) TIME WAVEFORM (B) SPECTROGRAM (A)
TIME WAVEFORM (B)
SPECTROGRAM (C)
BEAT EXTRACTED WAVEFORM
(BEAT COMPONENT DETECTION OUTPUT SIGNAL BT)

BEAT EXTRACTION APPARATUS AND METHOD, MUSIC-SYNCHRONIZED IMAGE DISPLAY APPARATUS AND METHOD, TEMPO VALUE DETECTION APPARATUS, RHYTHM TRACKING APPARATUS AND METHOD, AND MUSIC-SYNCHRONIZED DISPLAY APPARATUS AND METHOD

CROSS REFERENCES TO RELATED APPLICATIONS

The present invention contains subject matter related to Japanese Patent Application JP 2005-216786 filed in the Japanese Patent Office on Jul. 27, 2005, the entire contents of which are incorporated herein by reference.

BACKGROUND OF THE INVENTION

1. Field of the Invention

The present invention relates to an apparatus and a method for extracting the beat of the rhythm of a piece of music being played back while an input music signal is being played back. Furthermore, the present invention relates to an apparatus and a method for displaying an image synchronized with a piece of music being played back by using a signal synchronized with an extracted beat. Furthermore, the present invention relates to an apparatus and a method for extracting a tempo value of a piece of music by using a signal synchronized with a beat extracted from the piece of music being played back. Furthermore, the present invention relates to a rhythm tracking apparatus and method capable of following changes in tempo and fluctuations in rhythm even if the tempo is changed or the rhythm fluctuates in the middle of the playback of a piece of music by using a signal synchronized with an extracted beat. Furthermore, the present invention relates to a music-synchronized display apparatus and method capable of displaying, for example, lyrics in synchronization with a piece of music being playing back.

2. Description of the Related Art

A piece of music provided by a performer or by the voice of a singer is composed on the basis of a measure of time such as a bar or a beat. Musical performers use a bar and a beat as a basic measure of time. When taking a timing at which a musical instrument is played or a song is performed, musical performers perform by making a sound in accordance with which beat of which bar has currently been reached and never perform by making a sound a certain period of time after starting to play, as in a time stamp. Since a piece of music is defined by bars and beats, the piece of music can be flexibly dealt with even if there are fluctuations in tempo and rhythm, and conversely, even with a performance of the same musical score, individuality can be realized for each performer.

The performances of these musical performers are ultimately delivered to a user in the form of musical content. More specifically, the performance of each of the musical performers is mixed down, for example, in the form of two channels of stereo and is formed into a so-called one complete package (content upon which editing has been completed). This complete package is packaged as, for example, a CD (Compact Disc) with a format of a simple audio waveform of PCM (Pulse Code Modulation) and is delivered to a user. This is what is commonly called a sampling sound source.

Once the piece of music has been packaged as, for example, a CD, timing information, such as that regarding a bar and a beat, which musical performers are conscious about, is lost.

However, a human being has an ability of naturally recognizing timing information, such as that regarding a bar and a beat, by only hearing analog sound in which an audio waveform of PCM has been converted from digital to analog form. It is possible to naturally recognize the rhythm of a piece of music. Unfortunately, it is difficult for machines to do this. Machines can only understand the time information of a time stamp that is not directly related to a piece of music itself.

As an object to be compared with the above-described piece of music provided by a performer or by the voice of a singer, there is a karaoke (sing-along machine) system of the related art. It is possible for this system to display lyrics in time with the rhythm of the piece of music. However, such a karaoke system does not recognize the rhythm of the piece of music and only reproduces dedicated data called MIDI (Musical Instruments Digital Interface).

In an MIDI format, performance information and lyric information necessary for synchronized control, and time code information (time stamp) in which timing of sound production thereof is described (event time) are described. This MIDI data is created in advance by a content producer, and a karaoke playback apparatus only produces sound at a predetermined timing in accordance with instructions of the MIDI data. The apparatus reproduces a piece of music on the spot so to speak. As a result, entertainment can be enjoyed only in a limited environment of MIDI data and a dedicated playback apparatus therefor.

In addition to MIDI, numerous other various formats, such as SMIL (Synchronized Multimedia Integration Language) exist, but the basic way of concept is the same.

The dominant format of music content distributed in the market is a format in which a live audio waveform called the sampling sound source described above, such as PCM data typified by a CD or MP3 (MPEG (Moving Picture Experts Group) Audio layer 3), which is compressed audio thereof, is in the main rather than the above-described MIDI and SMIL.

The music playback apparatus provides music content to a user by converting these sampled audio waveforms of PCM, etc., from digital to analog form and outputting them. As seen in an FM radio broadcast, etc., there is an example in which an analog signal of an audio waveform itself is broadcast. Furthermore, there is an example in which a person plays live, such as in a concert, a live performance, etc., so that music content is provided to the user.

If a machine can automatically recognize a timing, such as a bar and a beat of a piece of music, from a live audio waveform of a piece of music that can be heard, synchronized functions, such as music and content on another medium being rhythm-synchronized like karaoke, can be realized even if no information, such as event time information, etc., of MIDI and SMIL, is provided in advance.

With respect to existing CD music content, a piece of music of an FM radio currently being heard, and a live piece of music currently being played, content on another medium, such as images and lyrics, can be played back in such a manner as to be synchronized with a piece of music that is heard, thereby broadening possibilities of new entertainment.

Attempts to extract tempo and to perform some kind of processing in synchronization with a piece of music have hitherto been proposed.

For example, in Japanese Unexamined Patent Application Publication No. 2002-116754, a method is disclosed in which self-correlation of a music waveform signal as a time-series signal is computed, beat structure of the piece of music is analyzed on the basis of the self-correlation, and the tempo of the piece of music is extracted on the basis of the analysis result. This is not a process for extracting tempo in real time while a piece of music is being played back, but is a process for extracting tempo as an offline process.

In Japanese Patent No. 3066528, it is disclosed that sound pressure data for each of a plurality of frequency bands is created from piece-of-music data, a frequency band at which rhythm is most noticeably taken is specified, and rhythm components are estimated on the basis of the period of change in the sound pressure of the specified frequency timing. Also, in Japanese Patent No. 3066528, an offline process is disclosed in which frequency analysis is performed a plurality of times to extract rhythm components from a piece of music.

SUMMARY OF THE INVENTION

Technologies for computing rhythm, beat, and tempo according to the related art are broadly classified into two types: one in which a music signal is analyzed in regions of time as in Japanese Unexamined Patent Application Publication No. 2002-116754, and another in which a music signal is analyzed in regions of frequency as in Japanese Patent No. 3066528.

In the former technology for performing analysis in regions of time, rhythm and a time waveform do not always coincide with each other, and therefore, in essence, the drawback thereof is extraction accuracy. In the latter technology for performing analysis in regions of frequency, data of all the intervals needs to be analyzed in advance by an offline process and therefore, the latter technology is not suitable for tracking a piece of music in real time. Some examples of this type of technology need to perform frequency analysis several times, and there is the drawback in that the amount of calculations becomes large.

In view of the above points, it is desirable to provide an apparatus and a method capable of extracting the beat (rhythm having a strong accent) of the rhythm of a piece of music with high accuracy while a music signal of the piece of music is being reproduced.

According to an embodiment of the present invention, the beat of the rhythm of a piece of music is extracted on the basis of the features of a music signal described below.

Part (A) of FIG. 1 shows an example of a time waveform of a music signal. As shown in part (A) of FIG. 1, when the time waveform of the music signal is viewed, it can be seen that there are portions where a large peak value is momentarily reached. Each of the portions that exhibit this large peak value is a signal portion corresponding to, for example, the beat of a drum. Therefore, in the present invention, such a portion where attack sounds of a drum and a musical instrument become strong is assumed as a candidate for a beat.

When the piece of music of part (A) of FIG. 1 is actually listened to, although not known because it is hidden in the time waveform of part (A) of FIG. 1, it can be noticed that a large number of beat components are contained at substantially equal time intervals. Therefore, it is not possible to extract the actual beat of the rhythm of the piece of music from only the large peak value portions of the time waveform of part (A) of FIG. 1.

Part (B) of FIG. 1 shows the spectrogram of the music signal of part (A) of FIG. 1. As shown in part (B) of FIG. 1, it can be seen that, from the waveform of the spectrogram of the music signal, the above-described hidden beat components are seen as portions where the power spectrum in the associated spectrogram greatly changes momentarily. When the sound is actually listened to, it can be confirmed that a portion where the power spectrum in this spectrogram greatly changes momentarily corresponds to beat components.

According to an embodiment of the present invention, there is provided a beat extraction apparatus including beat extraction means for detecting a portion where a power spectrum in a spectrogram of an input music signal greatly changes and for outputting a detection output signal that is synchronized in time to the changing portion.

According to the configuration of an embodiment of the present invention, the beat extraction means detects a portion where the power spectrum in the spectrogram of the input music signal greatly changes and outputs a detection output signal that is synchronized in time with the changing portion. Therefore, as the detection output signal, beat components corresponding to the portion where the power spectrum greatly changes, shown in part (B) of FIG. 1, are extracted and output.

In the beat extraction apparatus according to an embodiment of the present invention, the beat extraction means includes power spectrum computation means for computing the power spectrum of the input music signal; and amount-of-change computation means for computing the amount of change of the power spectrum computed by the power spectrum computation means and for outputting the computed amount of change.

According to the configuration of the embodiment of the present invention, the power spectrum of the music signal being reproduced is determined by the power spectrum computation means, and the change in the determined power spectrum is determined by the amount-of-change computation means. As a result of this process being performed on the constantly changing music signal, an output waveform having a peak at the position synchronized in time with the beat position of the rhythm of the piece of music is obtained as a detection output signal. This detection output signal can be assumed as a beat extraction signal extracted from the music signal.

According to an embodiment of the present invention, with respect to a so-called sampling sound source, it is also possible to obtain a beat extraction signal comparatively easily from a music signal in real time. Therefore, by using this extracted signal, musically synchronized operation with content on another medium becomes possible.

DESCRIPTION OF THE PREFERRED EMBODIMENTS

Figure 1:
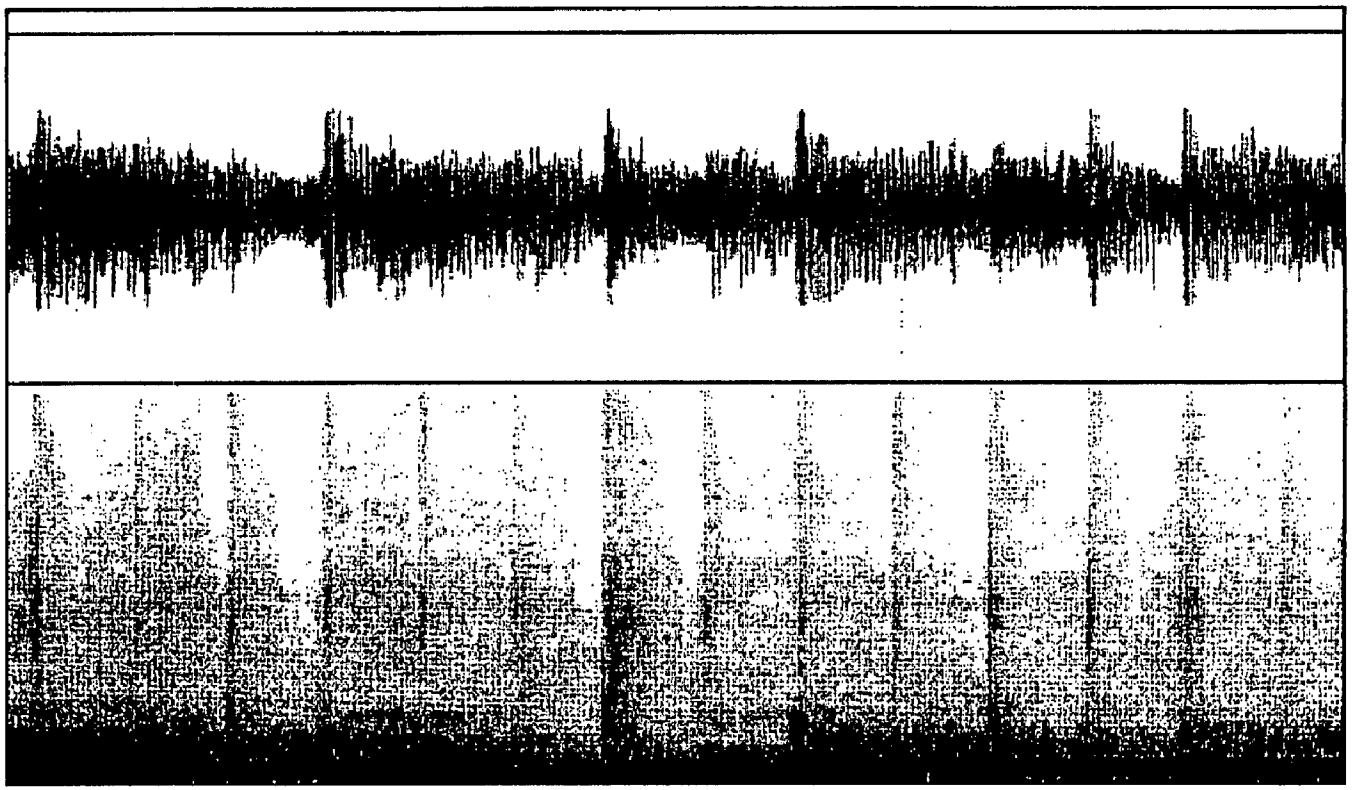
FIG. 1 is a waveform chart illustrating principles of a beat extraction apparatus and method according to an embodiment of the present invention.
Figure 2:
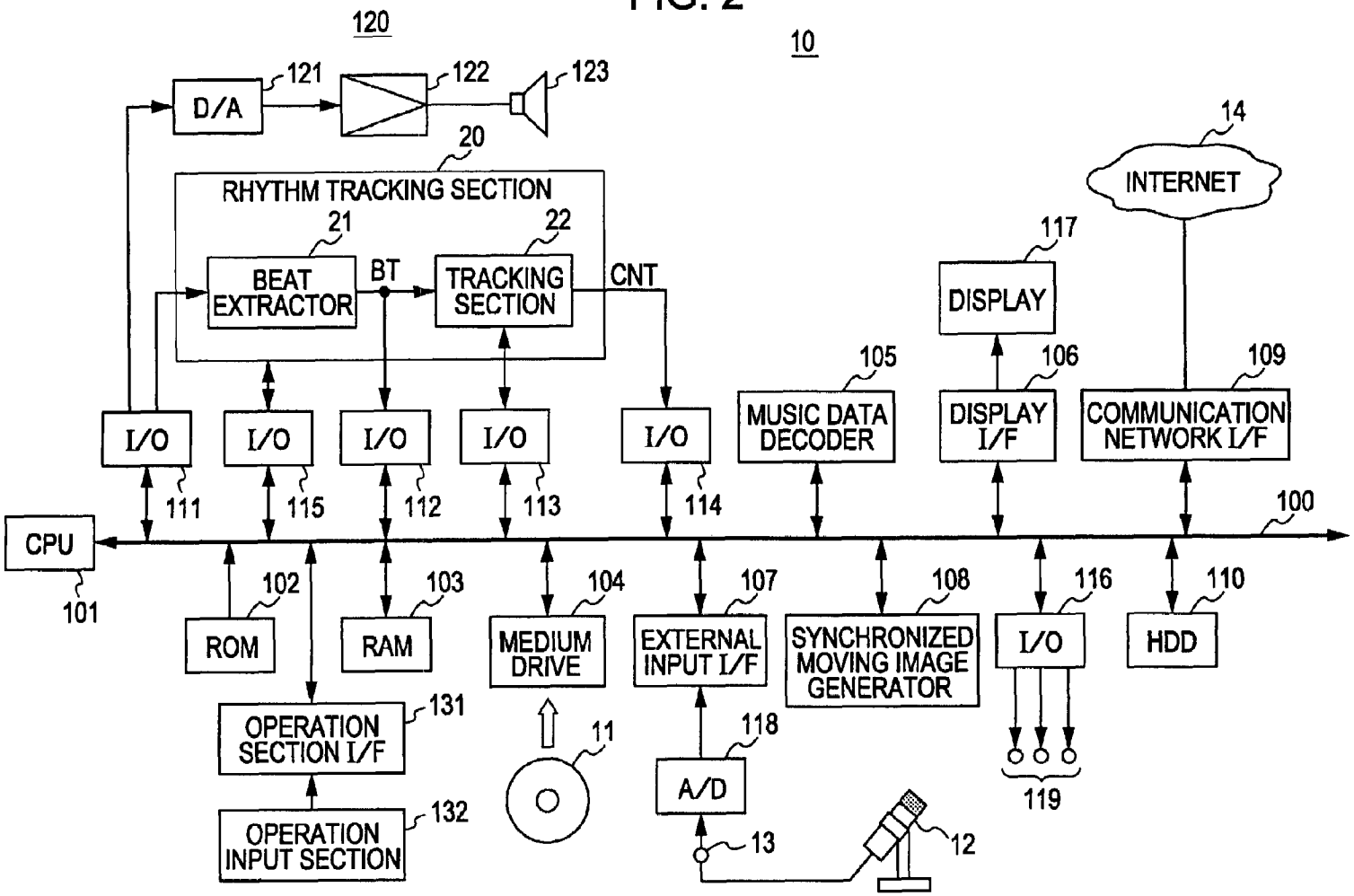
FIG. 2 is a block diagram showing an example of the configuration of a music content playback apparatus to which an embodiment of the present invention is applied.

Embodiments of the present invention will be described below with reference to the accompanying drawings. FIG. 2 is a block diagram of a music content playback apparatus 10 including a beat extraction apparatus and a rhythm tracking apparatus according embodiments of the present invention. The music content playback apparatus 10 of this embodiment is formed of, for example, a personal computer.

As shown in FIG. 2, in the music content playback apparatus 10 of this example, a program ROM (Read Only Memory) 102 and a RAM (Random Access Memory) 103 for a work area are connected to a CPU (Central Processing Unit) 101 via a system bus 100. The CPU 101 performs various kinds of function processing (to be described later) by performing processing in accordance with various kinds of programs stored in the ROM 102 by using the RAM 103 as a work area.

In the music content playback apparatus 10 of this example, a medium drive 104, a music data decoder 105, and a display interface (interface is described as I/F in the figures, and the same applies hereinafter) 106, an external input interface 107, a synchronized moving image generator 108, a communication network interface 109, a hard disk drive 110 serving as a large capacity storage section in which various kinds of data are stored, and I/O ports 111 to 116 are connected to the system bus 100. Furthermore, an operation input section 132, such as a keyboard and a mouse, is connected to the system bus 100 via an operation input section interface 131.

The I/O ports 111 to 115 are used to exchange data between the rhythm tracking section 20 as an embodiment of the rhythm tracking apparatus according to the present invention and the system bus 100.

In this embodiment, the rhythm tracking section 20 includes a beat extractor 21 that is an embodiment of the beat extraction apparatus according to the present invention, and a tracking section 22. The I/O port 111 inputs, to the beat extractor 21 of the rhythm tracking section 20, a digital audio signal (corresponding to a time waveform signal) that is transferred via the system bus 100, as an input music signal (this input music signal is assumed to include not only a music signal, but also, for example, a human voice signal and another signal of an audio band).

As will be described in detail later, the beat extractor 21 extracts beat components from the input music signal, supplies a detection output signal BT indicating the extracted beat components to the tracking section 22, and also supplies it to the system bus 100 via the I/O port 112.

As will be described later, first, the tracking section 22 computes a BPM (Beats Per Minute, which means how many beats there are in one minute and which indicates the tempo of a piece of music) value as a tempo value of input music content on the basis of the beat component detection output signal BT input to the tracking section 22, and generates a frequency signal at a phase synchronized with the beat component detection output signal BT by using a PLL (Phase Locked Loop) circuit.

Then, the tracking section 22 supplies, to the counter, the frequency signal from the PLL circuit as a clock signal, outputs, from this counter, a count value output CNT indicating the beat position in units of one bar of the piece of music, and supplies the count value output CNT to the system bus 100 via the I/O port 114.

Furthermore, in this embodiment, the tracking section 22 supplies a BPM value serving as an intermediate value to the system bus 100 via the I/O port 113.

The I/O port 115 is used to supply control data for the rhythm tracking section 20 from the system bus 100.

The I/O port 111 is also connected to the audio playback section 120. That is, the audio playback section 120 includes a D/A converter 121, an output amplifier 122, and a speaker 123. The I/O port 111 supplies a digital audio signal transferred via the system bus 100 to the D/A converter 121. The D/A converter 121 converts the input digital audio signal into an analog audio signal and supplies it to the speaker 123 via the output amplifier 122. The speaker 123 acoustically reproduces the input analog audio signal.

The medium drive 104 inputs, to the system bus 100, music data of music content stored on a disc 11, such as a CD or a DVD (Digital Versatile Disc) in which music content is stored.

The music data decoder 105 decodes the music data input from the medium drive 104 and reconstructs a digital audio signal. The reconstructed digital audio signal is transferred to the I/O port 111. The I/O port 111 supplies the digital audio signal (corresponding to a time waveform signal) transferred via the system bus 100 to the rhythm tracking section 20 and the audio playback section 120 in the manner described above.

In this example, a display device 117 composed of, for example, an LCD (Liquid Crystal Display) is connected to the display interface 106. On the screen of the display device 117, as will be described later, beat components extracted from the music data of music content, and a tempo value are displayed, and also, an animation image is displayed in synchronization with a piece of music, and lyrics are displayed as in karaoke.

In this example, an A/D (Analog-to-Digital) converter 118 is connected to the external input interface 107. An audio signal and a music signal, which are collected by an external microphone 12, is converted into a digital audio signal by an A/D converter 118 and is supplied to the external input interface 107. The external input interface 107 inputs, to the system bus 100, the digital audio signal that is externally input.

In this example, the microphone 12 is connected to the music content playback apparatus 10 as a result of a plug connected to the microphone 12 being inserted into a microphone terminal formed of a jack for a microphone provided in the music content playback apparatus 10. In this example, it is assumed that the beat of the rhythm is extracted in real time from the live music collected by the microphone 12, display synchronized with the extracted beat is performed, and a doll and/or a robot are made to dance in synchronization with the extracted beat. In this example, the audio signal input via the external input interface 107 is transferred to the I/O port 111 and is supplied to the rhythm tracking section 20. In this embodiment, the audio signal input via the external input interface 107 is not supplied to the audio playback section 120.

In this embodiment, on the basis of the beat component detection output signal BT from the beat extractor 21 of the rhythm tracking section 20, the synchronized moving image generator 108 generates an image, such as animation, the content of the image being changed in synchronization with the piece of music being played back.

On the basis of the count value output CNT from the rhythm tracking section 20, the synchronized moving image generator 108 may generate an image, such as animation, the content of the image being changed in synchronization with the piece of music being played back. When this count value output CNT is used, since the beat position within one bar can be known, it is possible to generate an image that accurately moves in accordance with the content as is written in the music score.

However, on the other hand, there are cases in which the beat component detection output signal BT from the beat extractor 21 contains beat components that are generated at positions that are not the original beat positions, which are not periodic, by so-called flavoring by a performer. Accordingly, when a moving image is to be generated on the basis of the beat component detection output signal BT from the beat extractor 21 as in this embodiment, there is the advantage of obtaining a moving image corresponding to an actual piece of music.

In this example, the communication network interface 109 is connected to the Internet 14. In the playback apparatus 10 of this example, access is made via the Internet 14 to a server in which attribute information of music content is stored, an instruction for obtaining the attribute information is sent to the server by using the identification information of the music content as a retrieval key word, and the attribute information sent from the server in response to the obtaining instruction is stored in, for example, a hard disk of the hard disk drive 110.

In this embodiment, the attribute information of the music content contains piece-of-music composition information. The piece-of-music composition information contains division information in units of piece-of-music materials and is also formed of information with which the so-called melody is determined, such as information of tempo/key/code/sound volume/beat in units of the piece-of-music materials of the piece of music, information of a musical score, information of code progress, and information of lyrics.

Here, the term "units of the piece-of-music materials" are units at which codes, such as beats and bars of a piece of music, can be assigned. The division information of the units of the piece-of-music materials is composed of, for example, relative position information from the beginning position of a piece of music and a time stamp.

In this embodiment, the count value output CNT obtained from the tracking section 22 on the basis of the beat component detection output signal BT extracted by the beat extractor 21 changes in synchronization with the division of the units of the piece-of-music materials. Therefore, it becomes possible to backtrack, for example, code progress and lyrics in the piece-of-music composition information that is the attribute information of the piece of music being played back in such a manner as to be synchronized with the count value output CNT obtained from the tracking section 22.

In this embodiment, the I/O port 116 is used to output the beat component detection output signal BT, the BPM value, and the count value output CNT, which are obtained from the rhythm tracking section 20 via the external output terminal 119. In this case, all the beat component detection output signal BT, the BPM value, and the count value output CNT may be output from the I/O port 116, or only those necessary may be output.

[Example of Configuration of the Rhythm Tracking Section 20]

Principles of the beat extraction and the rhythm tracking processing in this embodiment will be described first. In this embodiment, portions where, in particular, attack sounds of a drum and a musical instrument become strong are assumed as candidates for the beat of rhythm.

Figure 3:
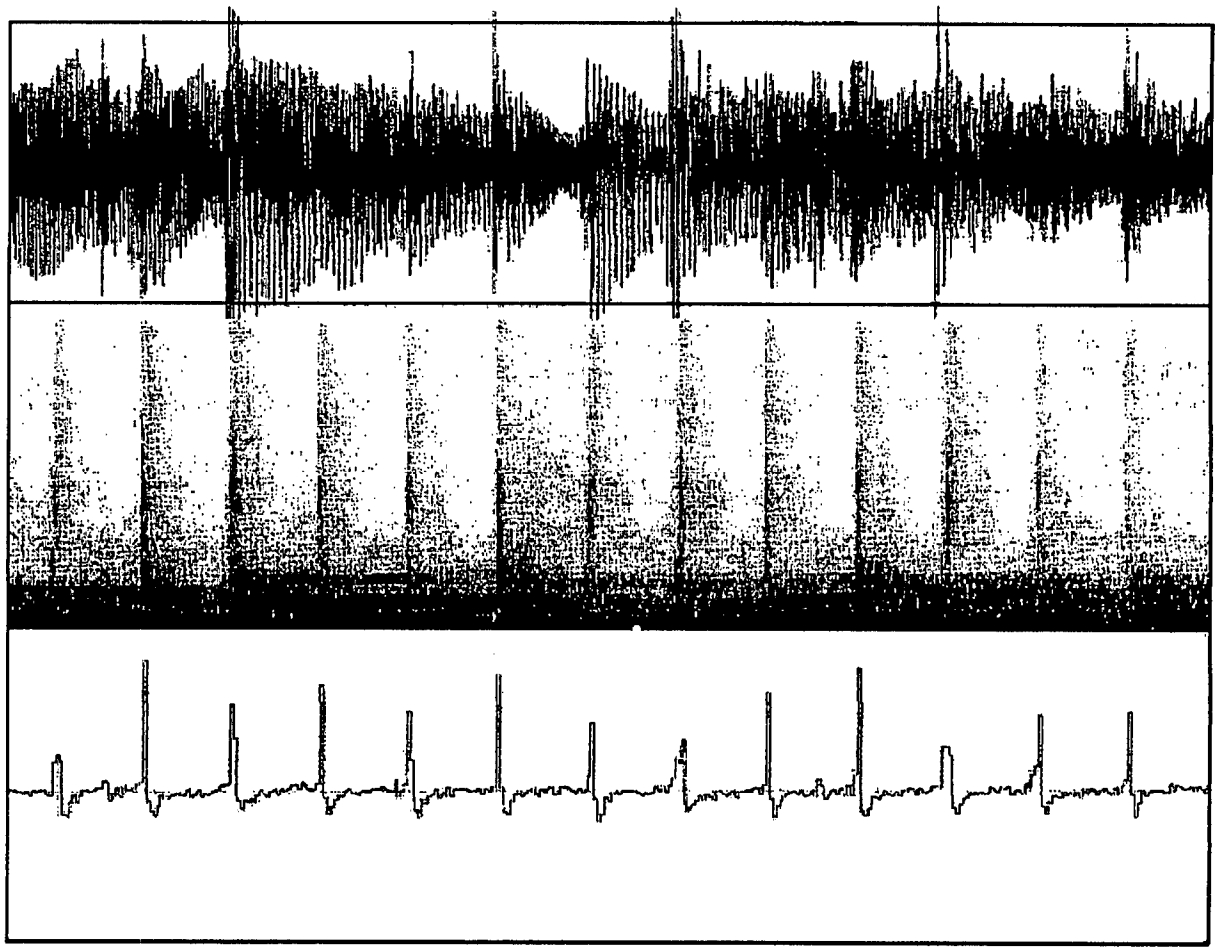
FIG. 3 is a waveform chart illustrating a beat extraction processing operation in the embodiment of FIG. 2.

As shown in part (A) of FIG. 3, when a time waveform of a music signal is viewed, it can be seen that there are portions where a peak value becomes large momentarily. This is a signal portion corresponding to the beat of the drum. However, when this piece of music is actually listened to, although not known because it is hidden in the time waveform, it is noticed that a larger amount of beat components are contained at substantially equal time intervals.

Next, as shown in part (B) of FIG. 3, when the waveform of the spectrogram of the music signal shown in part (A) of FIG. 3 is viewed, the hidden beat components can be seen. In part (B) of FIG. 3 is viewed, a portion where spectrum components greatly change momentarily is the hidden beat components, and it can be seen that the portion is repeated for a number of times in a comb-shaped manner.

When sound is actually listened to, it can be confirmed that the components that are repeated for a number of times in a comb-shaped manner correspond to the beat components. Therefore, in this embodiment, portions where a power spectrum in the spectrogram greatly changes momentarily are assumed as candidates for the beat of the rhythm.

Here, rhythm is a repetition of beats. Therefore, by measuring the period of the beat candidate of part (B) of FIG. 3, it is possible to know the period of the rhythm of the piece of music and the BPM value. In this embodiment, for measuring the period, a typical technique, such as a self-correlation calculation, is used.

Figure 4:
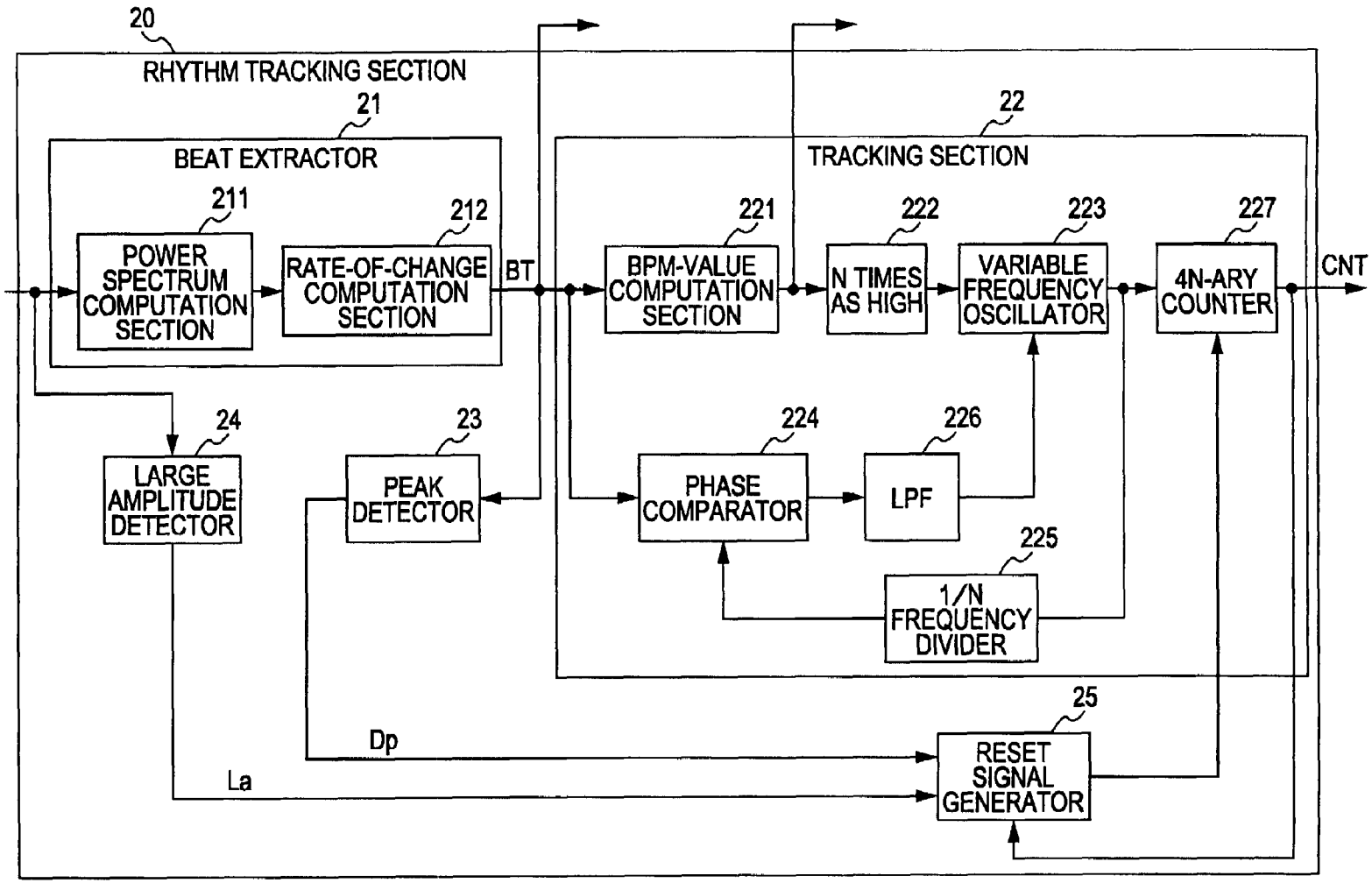
FIG. 4 is a block diagram of an embodiment of a rhythm tracking apparatus according to the present invention.

Next, a description will be given of a detailed configuration of the rhythm tracking section 20, which is an embodiment of the rhythm tracking apparatus according to the present invention, and of the processing operation thereof. FIG. 4 is a block diagram of an example showing a detailed configuration of the rhythm tracking section 20 according to this embodiment.

[Example of Configuration of the Beat Extractor 21 and the Processing Operation Thereof]

A description is given first of the beat extractor 21 corresponding to the embodiment of the beat extraction apparatus according to the present invention. As shown in FIG. 4, the beat extractor 21 of this embodiment includes a power spectrum computation section 211 and an amount-of-change computation section 212.

In this embodiment, audio data of the time waveform shown in part (A) of FIG. 3, of the music content being played back, is constantly input to the power spectrum computation section 211. That is, as described above, in accordance with a playback instruction from a user via the operation input section 132, in the medium drive 104, data of the instructed music content is read from the disc 11 and the audio data is decoded by the music data decoder 105. Then, the audio data from the music data decoder 105 is supplied to the audio playback section 120 via the I/O port 111, whereby the audio data is reproduced. Also, the audio data being reproduced is supplied to the beat extractor 21 of the rhythm tracking section 20.

There are cases in which an audio signal collected by the microphone 12 is supplied to the A/D converter, and audio data that is converted into a digital signal is supplied to the beat extractor 21 of the rhythm tracking section 20 via the I/O port 111. As described above, for this time, in the power spectrum computation section 211, for example, a computation such as an FFT (Fast Fourier Transform) is performed to compute and determine a spectrogram shown in part (B) of FIG. 3.

In the case of this example, in the power spectrum computation section 211, the resolution of the FFT computation is set to about 512 samples or 1024 samples and is set to about 5 to 30 msec in real time when the sampling frequency of the audio data input to the beat extractor 21 is 48 kHz. Furthermore, in this embodiment, by performing an FFT calculation while applying a window function, such as hunning and hamming, and while making the windows overlap, the power spectrum is computed to determine the spectrogram.

The output of the power spectrum computation section 211 is supplied to the rate-of-change computation section 212, whereby the rate of change of the power spectrum is computed. That is, in the rate-of-change computation section 212, differential computation is performed on the power spectrum from the power spectrum computation section 211, thereby computing the rate of change. In the rate-of-change computation section 212, by repeatedly performing the above-described differential computation on the constantly changing power spectrum, a beat extraction waveform output shown in part (C) of FIG. 3 is output as a beat component detection output signal BT.

The beat component detection output signal BT has enabled a waveform to be obtained in which spike-shaped peaks occur at equal intervals with respect to time unlike the original time waveform of the input audio data. Then, the peak that rises in the positive direction in the beat component detection output signal BT, shown in part (C) of FIG. 3, can be regarded as beat components.

The above operation of the beat extractor 21 will be described in more detail with reference to an illustration in FIG. 5 and a flowchart in FIG. 6. As shown in parts (A), (B), and (C) of FIG. 5, in this embodiment, when the window width is denoted as W, and when a power spectrum for the interval of the window width W is computed, next, the power spectrum is sequentially computed with respect to the input audio data by shifting the window by an amount of intervals that are divided by one integral number-th, in this example, by ⅛, so that an amount of 2 W/8 overlaps.

Figure 5:
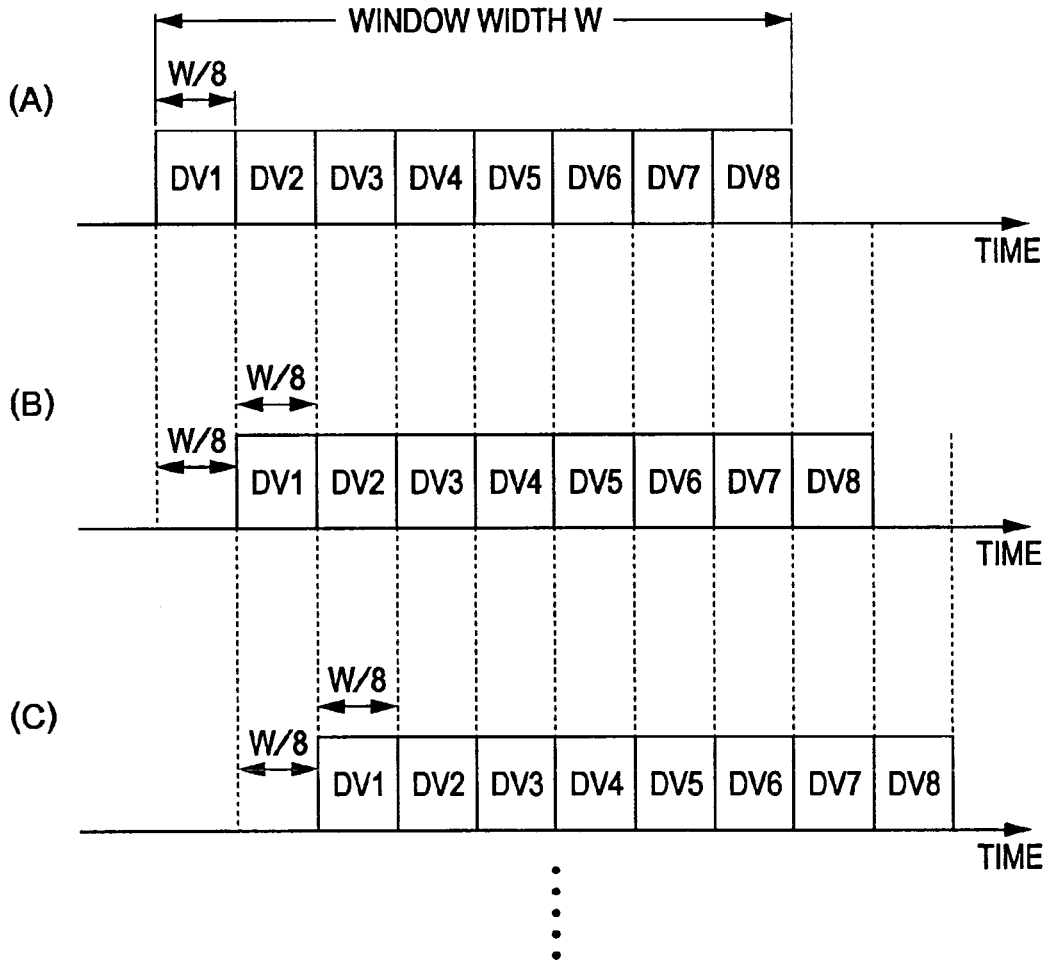
FIG. 5 illustrates the operation of a rate-of-change computation section in the embodiment of the beat extraction apparatus according to the present invention.
Figure 6:
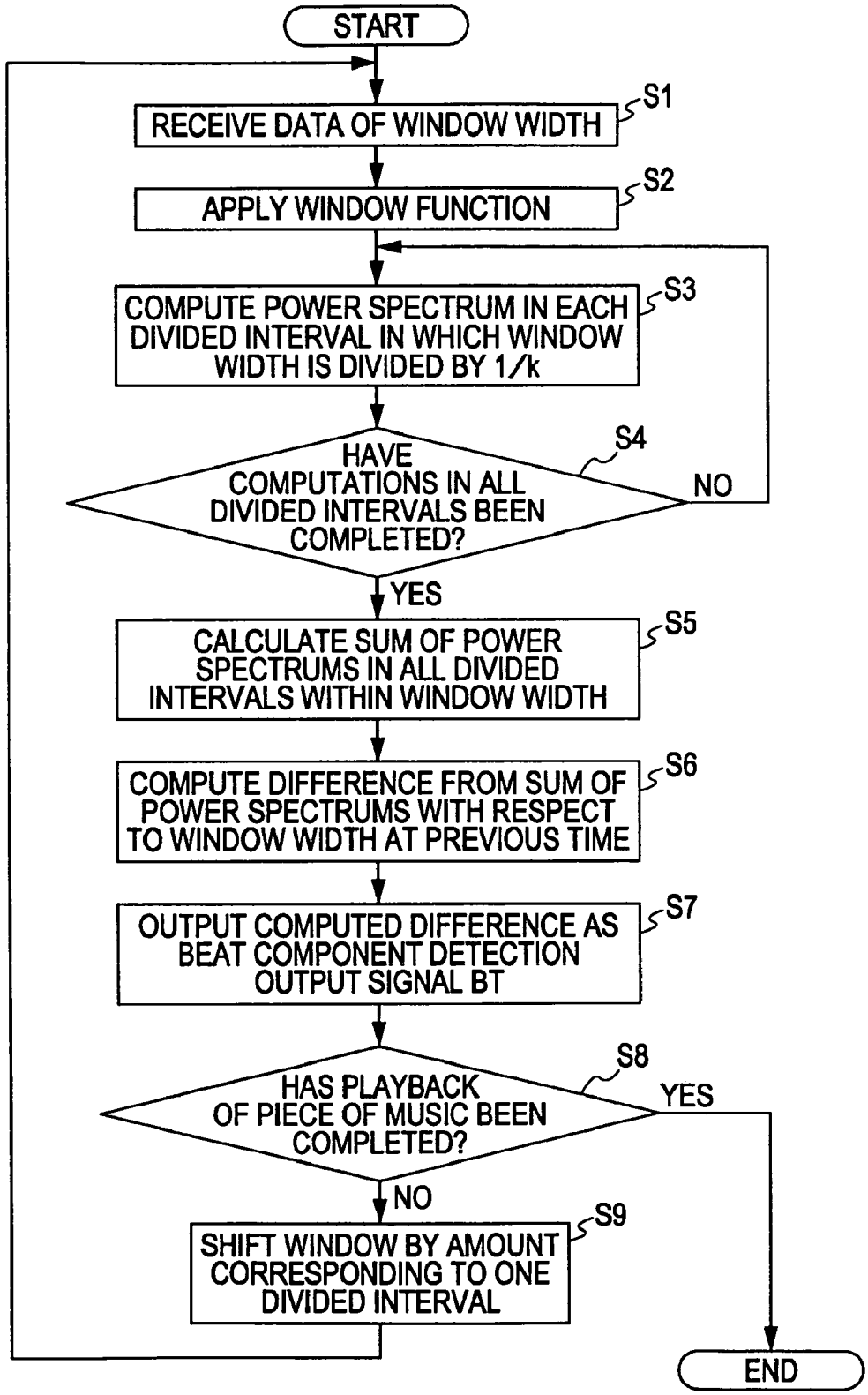
FIG. 6 is a flowchart illustrating a processing operation in the embodiment of the beat extraction apparatus according to the present invention.

That is, as shown in FIG. 5, in this embodiment, first, by setting, as a window width W, a time width for, for example, 1024 samples of the input audio data, which is data of the music content being played back, input audio data for the amount of the window width is received (step S1 of FIG. 6).

Next, a window function, such as hunning or hamming, is applied to the input audio data at the window width W (step S2). Next, an FFT computation for the input audio data is performed with respect to each of division sections DV1 to DV8 in which the window width W is divided by one integral multiple-th, in this example, by ⅛, thereby computing the power spectrum (step S3).

Next, the process of step S3 is repeated until the power spectrum is computed for all the division sections DV1 to DV8. When it is determined that the power spectrum has been computed for all the division sections DV1 to DV8 (step S4), the sum of the power spectrums computed in the division sections DV1 to DV8 is calculated, and it is computed as the power spectrum with respect to the input audio data for the interval of the window W (step S5). This has been the process of the power spectrum computation section 211.

Next, the difference between the sum of the power spectrums of the input audio data for the window width, computed in step S5, and the sum of the power spectrums computed at the window width W for this time, which is earlier in time by the amount of W/8, is computed (step S6). Then, the computed difference is output as a beat component detection output signal BT (step S7). The processes of step S6 and step S7 are processes of the rate-of-change computation section 212.

Next, the CPU 101 determines whether or not the playback of the music content being played back has been completed up to the end (step S8). When it is determined that the playback has been completed up to the end, the supply of the input audio data to the beat extractor 21 is stopped, and the processing is completed.

When it is determined that the playback of the music content being played back has been completed up to the end, the CPU 101 performs control so that the supply of the input audio data to the beat extractor 21 is continued. Also, in the power spectrum computation section 211, as shown in part (B) of FIG. 5, the window is shifted by the amount of one division interval (W/8) (step S9). The process then returns to step S1, where audio data for the amount of the window width is received, and processing of step S1 to step S7 described above is repeatedly performed.

If the playback of the music content being played back has not been completed, in step S9, the window is further shifted by the amount of one division interval (W/8) as shown in part (C) of FIG. 5, and processing of step S1 to step S7 is repeatedly performed.

In the manner described above, the beat extraction process is performed, and as the beat component detection output signal BT, an output of the beat extraction waveform shown in part (C) of FIG. 3 is obtained in synchronization with the input audio data.

The beat component detection output signal BT obtained in this manner is supplied to the system bus 100 via the I/O port 112 and is also supplied to the tracking section 22.

[Example of the Configuration of the Tracking Section 22 and Example of the Processing Operation thereof]

The tracking section 22 is basically formed of a PLL circuit. In this embodiment, first, the beat component detection output signal BT is supplied to a BPM-value computation section 221. This BPM-value computation section 221 is formed of a self-correlation computation processing section. That is, in the BPM-value computation section 221, a self-correlation calculation is performed on the beat component detection output signal BT, so that the period and the BPM value of the currently obtained beat extraction signal are constantly determined.

The obtained BPM value is supplied from the BPM-value computation section 221 via the I/O port 113 to the system bus 100, and is also supplied to a multiplier 222. The multiplier 222 multiplies the BPM value from the BPM-value computation section 221 by N and inputs the value to the frequency setting input end of a variable frequency oscillator 223 at the next stage.

The variable frequency oscillator 223 oscillates at an oscillation frequency at which the frequency value supplied to the frequency set input end is made to be the center frequency of free run. Therefore, the variable frequency oscillator 223 oscillates at a frequency N times as high as the BPM value computed by the BPM-value computation section 221.

The BPM value that means the oscillation frequency of the variable frequency oscillator 223 indicates the number of beats per minute. Therefore, for example, in the case of a four-four beat, the N-multiplied oscillation frequency is a frequency N times as high as that of a quarter note.

If it is assumed that N=4, since the frequency is 4 times as high as that of a quarter note, it follows that the variable frequency oscillator 223 oscillates at a frequency of a sixteenth note. This represents a rhythm that is commonly called 16 beats.

As a result of the above frequency control, an oscillation output that oscillates at a frequency N times as high as the BPM value computed by the BPM-value computation section 221 is obtained from the variable frequency oscillator 223. That is, control is performed so that the oscillation output frequency of the variable frequency oscillator 223 becomes a frequency corresponding to the BPM value of the input audio data. However, if kept in this state, the oscillation output of the variable frequency oscillator 223 is not synchronized in phase with the beat of the rhythm of the input audio data. This phase synchronization control will be described next.

That is, the beat component detection output signal BT synchronized with the beat of the rhythm of the input audio data, which is supplied from the beat extractor 21, is supplied to a phase comparator 224. On the other hand, the oscillation output signal of the variable frequency oscillator 223 is supplied to a 1/N frequency divider 225, whereby the frequency is divided by 1/N so that it is returned to the original frequency of the BPM value. Then, the 1/N divided output signal is supplied from the 1/N frequency divider 225 to the phase comparator 224.

In the phase comparator 224, the beat component detection output signal BT from the beat extractor 21 is compared in phase with the signal from the 1/N frequency divider 225 at, for example, the point of the rise edge, and an error output of the comparison is supplied to the variable frequency oscillator 223 via a low-pass filter 226. Then, control is performed so that the phase of the oscillation output signal of the variable frequency oscillator 224 is synchronized with the phase of the beat component detection output signal BT on the basis of the error output of the phase comparison.

For example, when the oscillation output signal of the variable frequency oscillator 223 is at a lagging phase with respect to the beat component detection output signal BT, the current oscillation frequency of the variable frequency oscillator 223 is slightly increased in a direction in which the lagging is recovered. Conversely, when the oscillation output signal is at a leading phase, the current oscillation frequency of the variable frequency oscillator 223 is slightly decreased in a direction in which the leading is recovered.

In the manner described above, the PLL circuit, which is a feedback control circuit employing so-called negative feedback, enables a phase match between the beat component detection output signal BT and the oscillation output signal of the variable frequency oscillator 23.

In this manner, in the tracking section 22, an oscillation clock signal that is synchronized with the frequency and the phase of the beat of the input audio data extracted by the beat extractor 21 can be obtained from the variable frequency oscillator 223.

Here, when the rhythm tracking section 20 outputs the output oscillation signal of the variable frequency oscillator 223 as a clock signal, an oscillation clock signal of a 4N beat, which is N times as high as the BPM value, is output as an output of the rhythm tracking section 20.

The oscillation output signal of the variable frequency oscillator 223 may be output as it is as a clock signal from the tracking section 22 and may be used. However, in this embodiment, if this clock signal is counted using a counter, a count value from 1N to 4N, which is synchronized with the beat, is obtained per bar, and the count value enables the beat position to be known. Therefore, the clock signal as an oscillation output of the variable frequency oscillator 223 is supplied as a count value input of the 4N-rary counter 227.

In this example, from the 4N-rary counter 226, a count value output CNT from 1N to 4N is obtained per bar of the piece of music of the input audio data in synchronization with the beat of the input audio data. For example, when N=4, the value of the count value output CNT repeatedly counts up from 1 to 16.

At this time, when the piece of music of the input audio data is a playback signal of live recording or live music collected from the microphone 12, the beat frequency and the phase thereof may fluctuate. The count value output CNT obtained from the rhythm tracking section 20 follows the fluctuation.

The beat component detection output signal BT is synchronized with the beat of the piece of music of the input audio data. However, it is not ensured that the count value of 1N to 4N from the 4N-rary counter 227 is completely synchronized with the bar.

In order to overcome this point, in this embodiment, correction is performed so that the 4N-rary counter 227 is reset using the peak detection output of the beat component detection output signal BT and/or a large amplitude of the time waveform so that the count value output CNT from the 4N-rary counter 227 is typically synchronized with the division of the bar.

That is, as shown in FIG. 4, in this embodiment, the beat component detection output signal BT from the beat extractor 21 is supplied to the peak detector 23. A detection signal Dp of the peak position on the spike, shown in part (C) of FIG. 3, is obtained from the peak detector 23, and the detection signal Dp is supplied to the reset signal generator 25.

Furthermore, the input audio data is supplied to the large amplitude detector 24. A detection signal La of the large amplitude portion of the time waveform, shown in part (A) of FIG. 3, is obtained from the large amplitude detector 24, and the detection signal La is supplied to the reset signal generator 25.

In this embodiment, the count value output CNT from the 4N-rary counter 227 is also supplied to the reset signal generator 25. When the value of the count value output CNT from the 4N-rary counter 227 is a value close to 4N, in this embodiment, for example, when N=4, in the reset signal generator 25, within the slight time width up to 4N=16 immediately after the value of the count value output CNT reaches 14 or 15, when there is a detection signal Dp from the peak detector 23 or a detection signal La from the large amplitude detector 24, the count value output CNT is forcedly reset to "1" by supplying either detection signal Dp or the detection signal La to the reset terminal of the 4N-rary counter 227 even before the count value output CNT reaches 4N.

As a result, even if there are fluctuations in units of bars, the count value output CNT of the 4N-rary counter 227 is synchronized with the piece of music of the input audio data.

After the beat is extracted in advance by the rhythm tracking section, the count value output CNT of the 4N-ary counter 227 in the tracking section 22 is determined on the basis of which beat the music content to be rhythm-tracked is. For example, in the case of a four beat, a 4N-ary counter is used, and in the case of a three beat, a 3N-ary counter is used. The fact about which beat the piece of music, on the basis of which a value to be multiplied to this N is determined, is input in advance to the playback apparatus 10 of the music content before the music content is played back by, for example, the user.

It is also possible for the user to omit the input as to which beat the piece of music is by automatically determining a value to be multiplied to N by the music content playback apparatus 10. That is, when the beat component detection output signal BT from the beat extractor 21 is analyzed, it can be seen that the peak value on the spike increases in units of bars, making it possible to estimate which beat the piece of music is and to determine a value to be multiplied to N.

However, in this case, there are cases in which a value to be multiplied to N is not appropriate in the initial portion of the piece of music, but it is considered that, in the case of an introduction portion of the piece of music, there is no problem in practical use.

The following may be performed: prior to playback, a portion of the piece of music of music content to be played back is played back, a beat component detection output signal BT from the beat extractor 21 is obtained, as to which beat of the piece of music the piece of music is detected on the basis of the signal BT, and a value to be multiplied to N is determined. Thereafter, the piece of music of the music content is played back from the beginning, and in the rhythm tracking section 20, the beat synchronized with the piece of music of the music content being played back is extracted.

The waveform of the oscillation signal of the variable frequency oscillator 223 may be a saw wave, a rectangular wave, or an impulse-shaped wave. In the above-described embodiment, phase control is performed by using a rise edge of a saw waveform as the beat of rhythm.

In the rhythm tracking section 20, each block shown in FIG. 4 may be realized by hardware, or may be realized by software by performing real-time signal processing by using a DSP, a CPU, and the like.

[Second Embodiment of the Rhythm Tracking Apparatus]

When the rhythm tracking section 20 of FIG. 4 is actually operated, the PLL circuit has contradictory properties such that, when the synchronization pull-in range is increased, phase jitter during steady time increases, and conversely, when phase jitter is to be decreased, the pull-in range of the PLL circuit becomes narrower.

When these properties apply to the rhythm tracking section 20, if the range of the BPM value, in which rhythm tracking is possible, is increased, jitter of the oscillation output clock during steady time increases by the order of, for example, ±several BPM, and a problem arises in that the fluctuation of a tracking error increases. On the contrary, when setting is performed so that phase jitter of a tracking error is to be decreased, the pull-in range of the PLL circuit becomes narrower, and a problem arises in that the range of the BPM value, in which tracking is possible, becomes narrower.

Another problem is that it sometimes takes time until tracking is stabilized from immediately after an unknown piece of music is input. The reason for this is that a certain amount of time is necessary for calculations by the self-correlation computation section constituting the BPM-value computation section 221 of FIG. 4. For this reason, in order for the BPM-value computation result of the BPM-value computation section 221 to be stabilized, a certain degree of calculation intervals is necessary for a signal input to the self-correlation computation section. This is due to typical properties of the self-correlation. As a result of this problem, there is a problem in that, in the initial portion of a piece of music, tracking becomes offset for the time being and it is difficult to obtain an oscillation output clock synchronized with the piece of music.

In the second embodiment of the rhythm tracking section 20, these problems are overcome by performing in the following manner.

If the piece of music to be input is known in advance, that is, if, for example, a file of the data of the music content to be played back is available at hand, an offline process is performed on it and a rough BPM value of the music content is determined in advance. In the second embodiment, in FIG. 4, this is performed by performing, in an offline manner, the process of the beat extractor 21 and the process of the BPM-value computation section 221. Alternatively, the music content to which meta-information of a BPM value is attached in advance may be used. For example, if BPM information with very rough accuracy of about 120±10 BPM is available, this improves the situation considerably.

When a rhythm tracking process is actually performed in real time during the playback of the associated music content, oscillation is started by using a frequency corresponding to the BPM value computed in an offline manner in the manner described above as an initial value of the oscillation frequency of the variable frequency oscillator 223. As a result, tracking offset when the playback of music content is started and phase jitter during steady time can be greatly reduced.

The processes in the beat extractor 21 and the BPM-value computation section 221 in the above-described offline processing use a portion of the rhythm tracking section 20 of FIG. 4, and the processing operation thereof is exactly the same as that described above. Accordingly, descriptions thereof are omitted herein.

[Third Embodiment of the Rhythm Tracking Section 20]

The third embodiment of the rhythm tracking apparatus is a case in which a piece of music to be input (played back) is unknown and an offline process is not possible. In the third embodiment, in the rhythm tracking section 20 of FIG. 4, initially, the pull-in range of the PLL circuit is set wider. Then, after rhythm tracking begins to be stabilized, the pull-in range of the PLL circuit is set again to be narrower.

As described above, in the third embodiment, the above-described problem of phase jitter can be effectively solved by using a technique for dynamically changing a parameter of the pull-in range of the PLL circuit of the tracking section 22 of the rhythm tracking section 20.

[Example of Application using Output of the Rhythm Tracking Section 20]

In this embodiment, various applications are implemented by using output signals from the rhythm tracking section 20, that is, the beat component detection output signal BT, the BPM value, and the count value output CNT.

Figure 7:
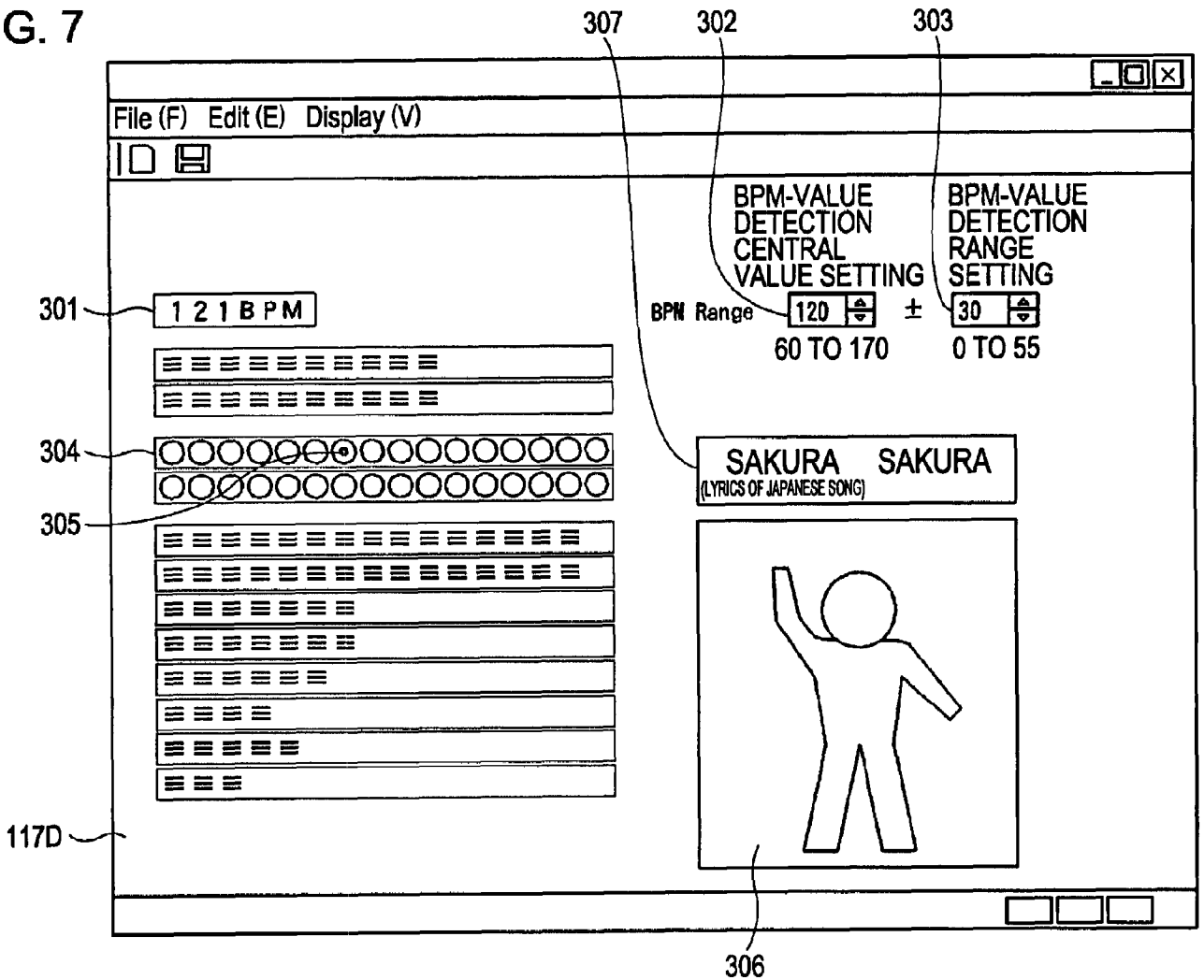
FIG. 7 shows an example of a display screen in an embodiment of a music-synchronized display apparatus according to the present invention.

In this embodiment, as described above, on the display screen of the display device 117, display using an output signal from the rhythm tracking section 20 is performed. FIG. 7 shows an example of display of a display screen 117D of the display device 117 in this embodiment. This corresponds to a display output form in an embodiment of a music-synchronized display apparatus.

As shown in FIG. 7, on the display screen 117D of the display device 117, a BPM-value display column 301, a BPM-value detection central value setting column 302, a BPM-value detection range setting column 303, a beat display frame 304, a music-synchronized image display column 306, a lyrics display column 307, and others are displayed.

On the BPM-value display column 301, a BPM value computed by the BPM-value computation section 221 of the rhythm tracking section 20 from the audio data of music content being played back is displayed.

In this embodiment, the user can set a BPM-value detection central value and a permissible error range value of the BPM detection range from the central value as parameter values of the BPM detection range in the rhythm tracking section 20 via the BPM-value detection central value setting column 302 and the BPM-value detection range setting column 303. These parameter values can also be changed during a playback operation.

In this example, as described above, for the beat display frame 304, when the music content to be played back is four beat, since the beat for which tracking is performed is given by a hexadecimal number, a 16-beat display frame is displayed, and the beat of the music content being played back is synchronously displayed in the beat display frame 304. In this example, the beat display frame 304 is formed in such a manner that 16-beat display frames are provided at upper and lower stages. Each of the 16 beat display frames is formed of 16 white circle marks. As a current beat position display 305, for example, a small rectangular mark is displayed within a white circle mark at a position corresponding to the current beat position, which is extracted from the audio data of the music content among the 16 white circle marks.

That is, the current beat position display 305 changes according to a change in the count value output CNT from the rhythm tracking section 20. As a result, the beat of the music content being played back is synchronously changed and displayed in real time in such a manner as to be synchronized with the audio data of the music content being played back.

As will be described in detail later, in this embodiment, dancing animation is displayed in the music-synchronized image display column 306 in synchronization with the beat component detection output signal BT from the beat extractor 21 of the rhythm tracking section 20.

As will be described in detail later, in this embodiment, lyrics of the music content being played back are character-displayed in synchronization with the playback of the associated music content.

As a result of adopting such a display screen structure, in the music content playback apparatus of this embodiment, when the user instructs the starting of the playback of the music content, the audio data of the music content is acoustically played back by the audio playback section 120, and the audio data being reproduced is supplied to the rhythm tracking section 20.

With respect to the music content being played back, the beat is extracted by the rhythm tracking section 20, a BPM value is computed, and the BPM value currently being detected is displayed in the BPM-value display column 301 of the display screen 117.

Then, on the basis of the computed BPM value and the beat component detection output signal BT that is extracted and obtained by the beat extractor 21, beat tracking is performed by the PLL circuit section, and a count value output CNT that gives the beat synchronized with the music content being played back in the form of a hexadecimal number is obtained from the 4N-rary counter 227. Based on this count value output CNT, synchronized display is performed in the beat display frame 304 by the current beat position display 305. As described above, the beat display frame 304 is formed in such a manner that 16-beat display frames are provided at upper and lower stages, and the current beat position display 305 is moved and displayed in such a manner as to be alternately interchanged between the upper stage and the lower stage.

[Embodiment of the Music-Synchronized Image Display Apparatus (Dancing Animation)]

Next, a description is given of animation displayed in the music-synchronized image display column 306. As described above, in the synchronized moving image generator 108, this animation image is generated. Therefore, the portion formed of the rhythm tracking section 20, the synchronized moving image generator 108, and the display interface 106 of FIG. 2 constitutes the embodiment of the music-synchronized image display apparatus.

The music-synchronized image display apparatus may be formed of hardware. The portions of the rhythm tracking section 20 and the synchronized moving image generator 108 may be formed of a software process to be performed by the CPU.

Figure 8:
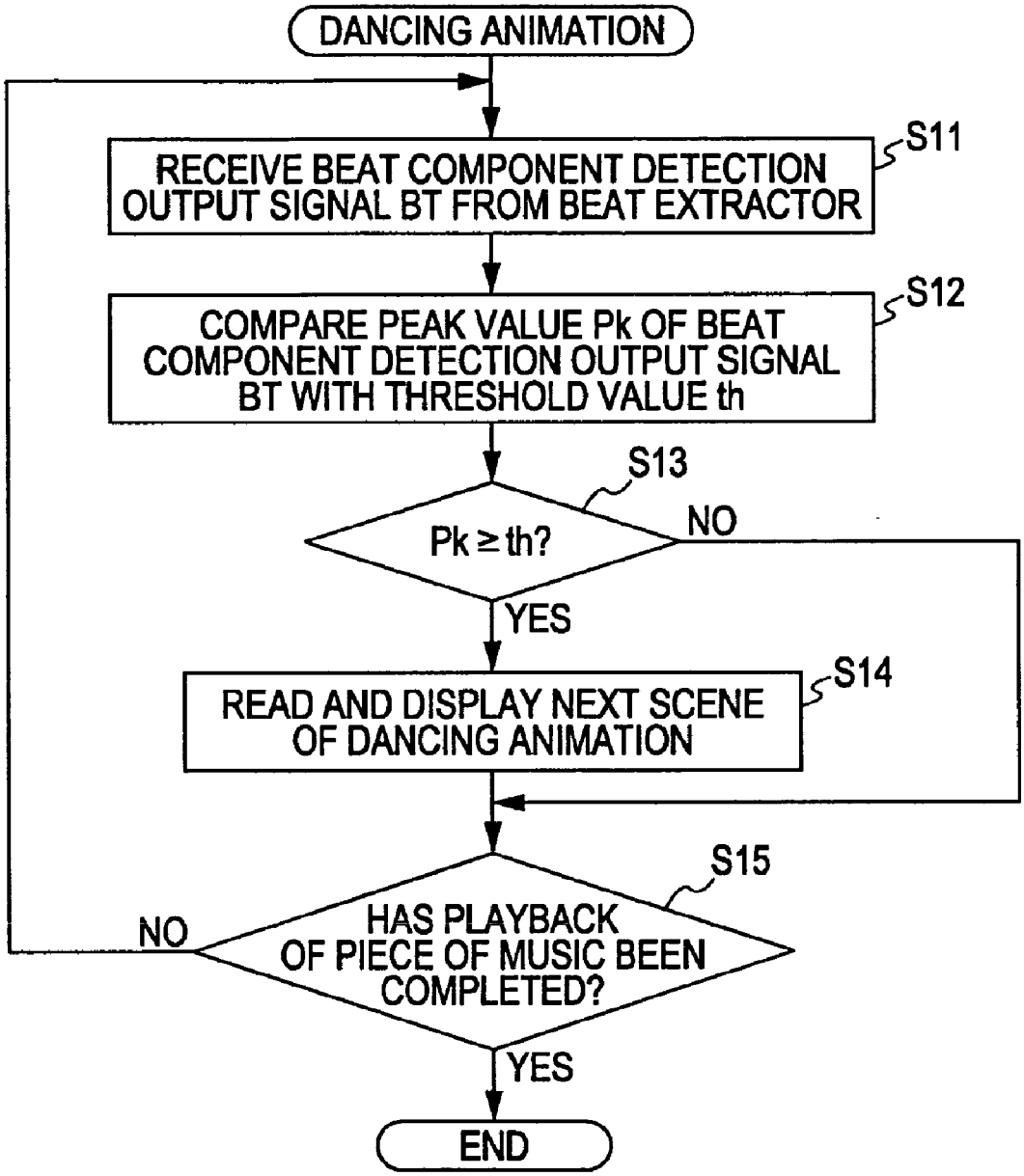
FIG. 8 is a flowchart illustrating an embodiment of the music-synchronized image display apparatus according to the present invention.

FIG. 8 is a flowchart illustrating a music-synchronized image display operation to be performed by the embodiment of the music-synchronized image display apparatus. The process of each step in the flowchart of FIG. 8 is performed by the synchronized moving image generator 108 under the control of the CPU 101 in the embodiment of FIG. 4.

In this embodiment, the synchronized moving image generator 108 has stored image data of a plurality of scenes of dancing animation in advance in a storage section (not shown). Scenes of the dancing animation are sequentially read from the storage section in synchronization with the beat of the music content, and are displayed in the music-synchronized image display column 306, thereby displaying the dancing animation.

That is, under the control of the CPU 101, the synchronized moving image generator 108 receives the beat component detection output signal BT from the beat extractor 21 of the rhythm tracking section 20 (step S11).

Next, in the synchronized moving image generator 108, the peak value Pk of the beat component detection output signal BT is compared with the predetermined threshold value th (step S12). It is then determined whether or not the peak value Pk of the beat component detection output signal BT≧th (step S13).

When it is determined in step S13 that Pk≧th, the synchronized moving image generator 108 reads the image data of the next scene of the dancing animation stored in the storage section, and supplies the image data to the display interface 106, so that the animation image in the music-synchronized image display column 306 of the display device is changed to the next scene (step S14).

After step S14 or when it is determined in step S13 that Pk is not≧th, the synchronized moving image generator 108 determines whether or not the playback of the piece of music has been completed (step S15). When the playback of the piece of music has not been completed, the process returns to step S11, and processing of step S11 and subsequent steps is repeatedly performed. When it is determined in step S15 that the playback of the piece of music has been completed, the processing routine of FIG. 8 is completed, and the display of the dancing animated image in the music-synchronized image display column 306 is stopped.

By varying the threshold value th with which a comparison is made in step S12 rather than maintaining it so as to be fixed, the peak value at which Pk≧th holds as the comparison result in step S13 can be changed. Thus, a dancing animated image more appropriate to the feeling when the piece of music is listened to can be displayed.

As is also described above, in the embodiment of FIG. 8, a music synchronization image is displayed using the beat component detection output signal BT from the beat extractor 21. Alternatively, the following may be performed: in place of the beat component detection output signal BT, the count value output CNT from the tracking section 22 is received, and the next scene of the dancing animation is read one after another in synchronization with the change in the count value output CNT and is displayed.

In the above-described embodiment, the image data of dancing animation is stored in advance, and the next scene of the dancing animation is read one after another in synchronization with the peak value Pk of the beat component detection output signal BT or in synchronization with the change in the count value output CNT from the rhythm tracking section 20. Alternatively, a program for generating an image of dancing animation in real time in synchronization with the peak value Pk of the beat component detection output signal BT or in synchronization with the change in the count value output CNT from the rhythm tracking section 20 may be executed.

The image to be displayed in synchronization with the piece of music is not limited to animation, and may be a moving image or a still image that is provided in such a manner as to be played back in synchronization with a piece of music. For example, in the case of a moving image, a display method of changing a plurality of moving images in synchronization with the piece of music can be employed. In the case of a still image, it can be displayed in a form identical to that of animation.

[Embodiment of the Music-Synchronized Display Apparatus (Display of Lyrics)]

As described above, in the music content playback apparatus 10 of the embodiment of FIG. 4, attribute information of music content is obtained via a network, such as the Internet, and is stored in a hard disk of the hard disk drive 110. The hard disk contains the data of the lyrics of pieces of music.

In the music content playback apparatus 10 of this embodiment, lyrics are displayed in synchronization with the piece of music being played back by using lyric information of the attribute information of the music content. In a so-called karaoke system, lyrics are displayed in sequence according to the time stamp information. In contrast, in this embodiment, lyrics are displayed in synchronization with the audio data of a piece of music being played back. Therefore, even if the beat of the piece of music being played back fluctuates, the lyrics to be displayed are displayed in such a manner as to follow the fluctuations.

In the example of FIG. 4, the embodiment of the music-synchronized display apparatus for displaying lyrics is implemented by a software process to be performed by the CPU 101 in accordance with a program stored in the ROM 102.

In this embodiment, when the starting of the playback of music content is instructed, audio data of the associated music content is received from, for example, the medium drive 104, and the playback thereof is started. Also, by using the identification information of the music content to be played back, stored in the associated medium drive 104, the attribute information of the music content whose playback has been instructed to be started is read from the hard disk of the hard disk drive 110.

Figure 9:
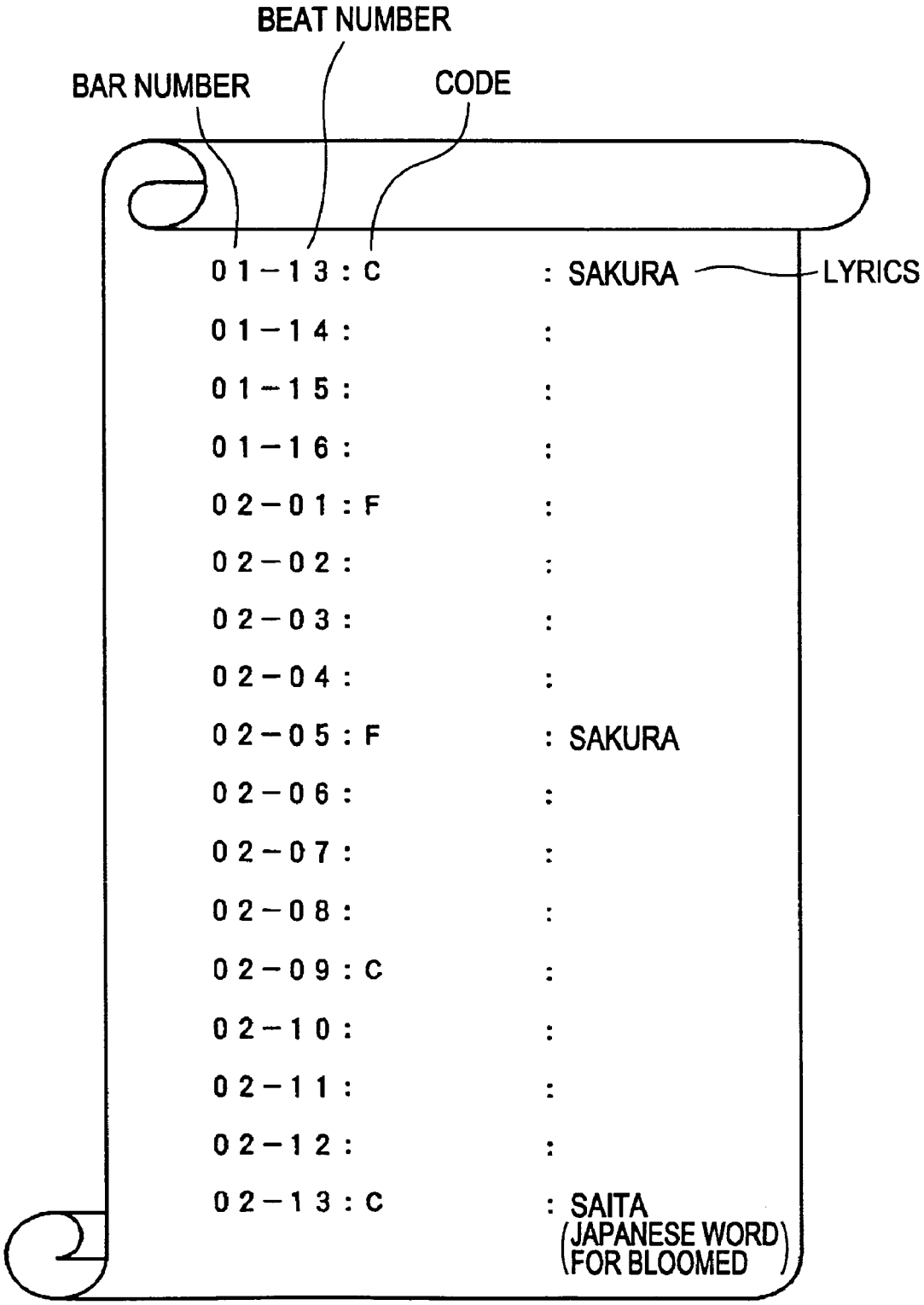
FIG. 9 illustrates an embodiment of the music-synchronized display apparatus according to the present invention.

FIG. 9 shows an example of attribute information of music content to be read at this time. That is, as shown in FIG. 9, the attribute information is formed of a bar number and a beat number of music content to be played back, and lyrics and codes at the position of each of the bar number and the beat number. The CPU 101 knows the bar number and the beat number at the current playback position on the basis of the count value output CNT from the rhythm tracking section 20, determines codes and lyrics, and sequentially displays the lyrics in the lyrics display column 307 in synchronization with the piece of music being played back on the basis of the determination result.

Figure 10:
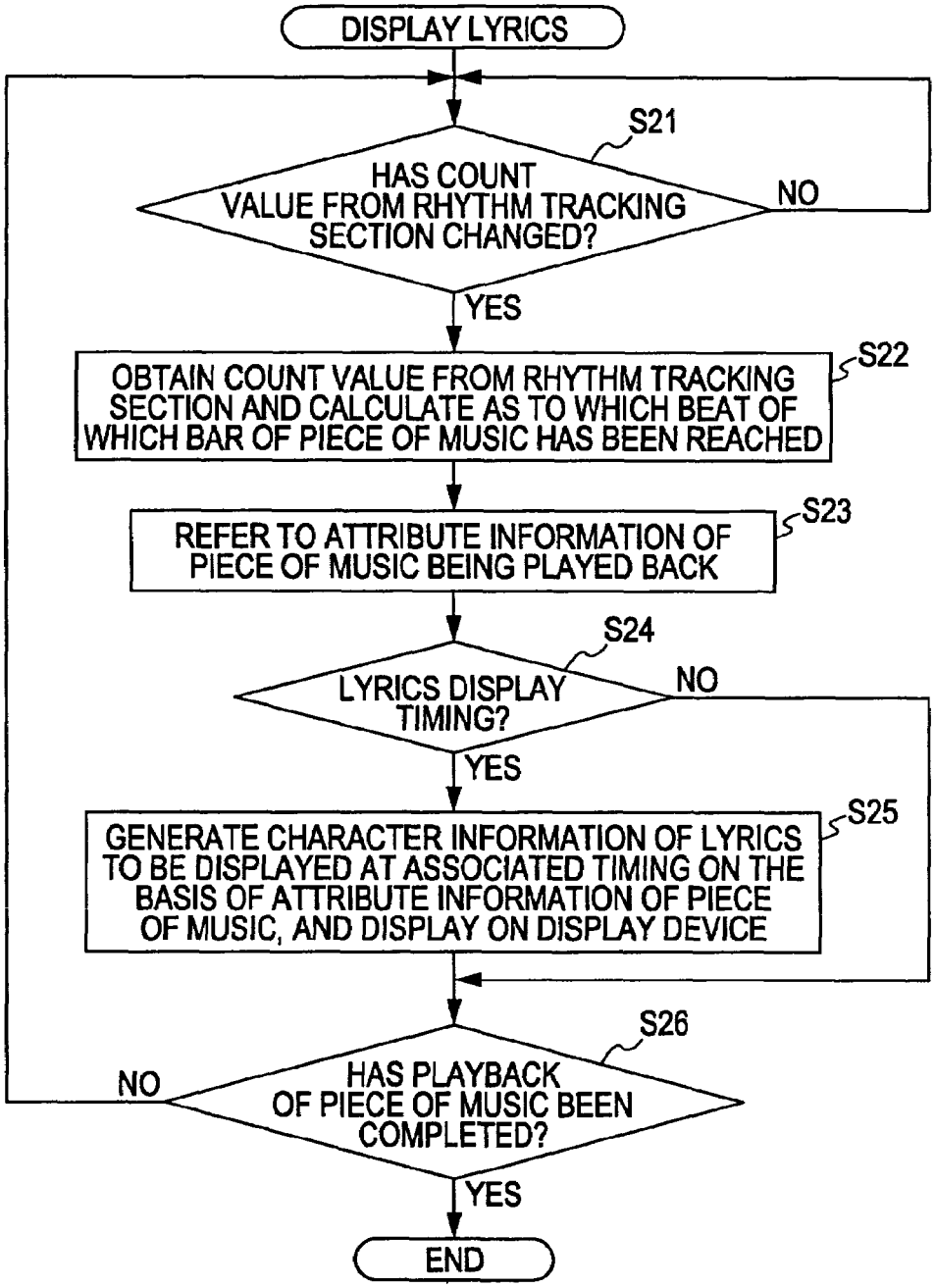
FIG. 10 is a flowchart illustrating an embodiment of the music-synchronized display apparatus according to the present invention.

FIG. 10 is a flowchart for a lyrics display process in this embodiment. Initially, the CPU 101 determines whether or not the count value of the count value output CNT from the rhythm tracking section 20 has changed (step S21).

When it is determined in step S21 that the count value of the count value output CNT has changed, the CPU 101 calculates as to which beat of which bar of the piece of music being played back the piece of music has been reached on the basis of the count value of the count value output CNT.

As described above, the count value output CNT changes in a 4N-ary manner in units of one bar. Of course, it is possible to know which bar of the piece of music has been reached by separately counting the bar in sequence from the beginning of the piece of music.

After step S22, the CPU 101 refers to the attribute information of the piece of music being played back (step S23) and determines whether or not the bar position and the beat position of the piece of music being played back, which are determined in step S22, correspond to the lyrics display timing at which the lyrics are provided at the associated bar and beat positions (step S24).

When it is determined in step S24 that the lyrics display timing has been reached, the CPU 101 generates character information to be displayed at the associated timing on the basis of the attribute information of the piece of music, supplies the character information to the display device 117 via the display interface 106, and displays it in the lyrics display column 307 of the display screen 117D (step S25).

When it is determined in step S24 that the lyrics display timing has not been reached, after step S25, the CPU 101 determines whether or not the playback of the piece of music has been completed (step S26). When the playback of the piece of music has not been completed, the process returns to step S21, and processing of step S21 and subsequent steps is repeated. When it is determined in step S26 that the playback of the piece of music has been completed, the processing routine of FIG. 10 ends, and the lyrics display in the lyrics display column 307 is stopped.

In the music-synchronized image display apparatus, codes of a piece of music may be displayed without being limited to only lyrics or in place of lyrics. For example, pressing patterns of fingers of a guitar, which correspond to codes of the piece of music, may be displayed.

In the above-described embodiment, on the display screen of a personal computer, lyrics are displayed. When the embodiment of the present invention is applied to a portable music playback apparatus, as shown in FIG. 11, dancing animation and lyrics described above can be displayed on a display section 401D provided in a remote commander 401 connected to a music playback apparatus 400.

Figure 11:
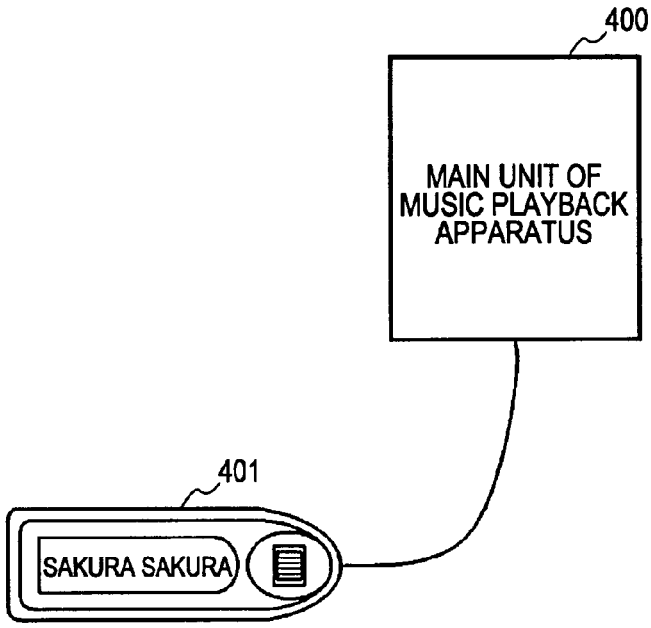
FIG. 11 shows an example of an apparatus in which an embodiment of the music-synchronized display apparatus according to the present invention is applied.

In this case, the portable music playback apparatus performs a rhythm tracking process after the playback is started, knows the position and the timing of bars of the piece of music being played back, and can sequentially display, for example, lyrics on the display section 401D of the remote commander 401 available at hand, as shown in FIG. 11, in such a manner as to be synchronized with the piece of music while comparing with the attribute information in real time.

[Another Example of Application using Output of the Rhythm Tracking Section 20]

In the above-described example of the application, an animation image and lyrics of a piece of music are displayed in synchronization with the piece of music. However, in this embodiment, some processing can easily be performed in synchronization with the bar and the beat of the piece of music being played back. Therefore, it is possible to easily perform predetermined arrangements, to perform a special effect process, and to remix another piece of music data.

As effect processes, processes for applying, for example, distortion and reverb on playback audio data are possible.

Remixing is a process performed by a typical disc jockey, and is a method for mixing a plurality of musical materials into a piece of music being played back in units of certain bars and beats so that musical characteristics are not deteriorated. This is a process for mixing, without causing an uncomfortable feeling, a plurality of musical materials into a piece of music being played back in accordance with music theory by using piece-of-music composition information that is provided in advance, such as divisions of bars (divisions in units of piece-of-music materials), tempo information, and code information.

For this reason, in order to realize this remixing, for example, musical instrument information is contained in attribute information obtained from the server via the network. This musical instrument information is information on musical instruments, such as a drum and a guitar. For example, musical performance patterns of a drum and a percussion instrument for one bar can be recorded as attribute information, so that they are used repeatedly in a loop form. The musical performance pattern information of those musical instruments can also be used for remixing. Furthermore, music data to be remixed may also be extracted from another piece of music.

In the case of remixing, in accordance with instructions from the CPU 101, a process is performed for mixing audio data to be remixed other than the piece of music being played back into the audio data being reproduced in synchronization with the count value output CNT from the rhythm tracking section 20 while referring to the codes of the attribute information shown in FIG. 9.

According to the embodiments described above, the following problems can be solved.

(1) In the related art, as typified by MIDI and SMIL, medium timing control is possible at only the time of a time stamp that is generated in advance by a content producer. Therefore, musical synchronization with content on another medium is not possible with respect to a live audio waveform (sampling sound source), such as a PCM having no time stamp information.

(2) In the related art, when generating data of MIDI and SMIL, it is necessary to separately compute and attach time stamp information on the basis of a musical score. This operation is quite complicated. Furthermore, since it is necessary to have all the time stamp information of a piece of music, the data size becomes large and handling is complicated.

(3) MIDI and SMIL data have in advance sound production timing as time stamp information. As a consequence, when tempo changes or rhythm fluctuates, it is necessary to recompute the time stamp information, and flexible handling is difficult.

(4) For example, it may be impossible to achieve synchronization by the existing technology with respect to a piece of music that is heard in real time, such as a piece of music that is currently listened to, a piece of music heard from a radio, live music currently being played back.

With respect to the problem (1) described above, according to the above-described embodiment, it is possible for the apparatus to automatically recognize timing of a bar and a beat of a piece of music. Therefore, music-synchronized operation with content on another medium becomes possible also with respect to a sampling sound source that is in the main at present. Furthermore, by combining with the piece of music information, such as a musical score, which is generally easy to obtain, it is possible for the apparatus to play back a piece of music while automatically following the musical score.

For example, when the embodiment of the present invention is applied to a stereo system of the related art, also, in content of a PCM data format like an existing CD, by only playing back a CD, it is possible to automatically recognize the rhythm of the piece of music being played back and possible to display lyrics in real time in time with the piece of music as in karaoke of the related art. Furthermore, by combining with image processing, display synchronized with image animation, such as a character performing dancing, becomes possible.

Furthermore, if, in addition to the beat output signal extracted in this embodiment, the piece of music information, such as code information of a musical score, is also used, other wide applications, such as re-arrangement of a piece of music itself becoming possible in real time, can be expected.

With respect to the problem (2) described above, according to the above-described embodiments, since an ability for automatically recognizing a timing of a bar and a beat of a piece of music can be imparted to a karaoke apparatus, karaoke data creation at present becomes even more simpler. Then, it is possible to use common and versatile data that is easy to obtain, like a musical score in synchronization with the automatically recognized timing of a bar and a beat of a piece of music.

For example, since the apparatus can automatically recognize a situation as to which beat of which bar the piece of music that is currently being heard has been reached, it is possible to display lyrics as written in a musical score even if there is no time stamp information corresponding to a specific event time. Furthermore, it is possible to reduce the amount of data and the size of a memory for assigning time stamp information.

With respect to the problem (3) described above, in the case of a system like a karaoke, when representing changes in tempo or fluctuations in rhythm in the middle of a piece of music, it is necessary to perform complex time-stamp calculations. Furthermore, when it is desired to change fluctuations in tempo and rhythm in an interactive manner, it is necessary to calculate the time stamp again.

With respect to the above, since the apparatus according to the above-described embodiments can track fluctuations in tempo and rhythm, it is not necessary to change data at all and playing can be continued without being offset.

With respect to the problem (4), according to the above-described embodiments, since an ability for automatically recognizing a timing of a bar and a beat of a piece of music can be imparted to a karaoke apparatus, functions of live performance and real-time karaoke can be realized. For example, it is possible to achieve rhythm synchronization with respect to live sound currently played by somebody and possible to follow a musical score. As a result, for example, it is possible to synchronously display lyrics and images in synchronization with a live performance, to control another sound source apparatus so as to superimpose sound, and to cause another apparatus to be synchronized with a piece of music. For example, lighting can be controlled or setting-off of fireworks can also be controlled by the catchy part of a song or a climax phrase thereof. The same applies to a piece of music that is heard from an FM radio.

Other Embodiments

In the beat extractor 21 of the above-described embodiment, a power spectrum is computed with respect to the components of all the frequency bands of input audio data, and the rate of change thereof is computed to extract beat components. Alternatively, after components that are assumed comparatively not related to the extraction of beat components are removed, a beat extraction process may be performed.

Figure 12:
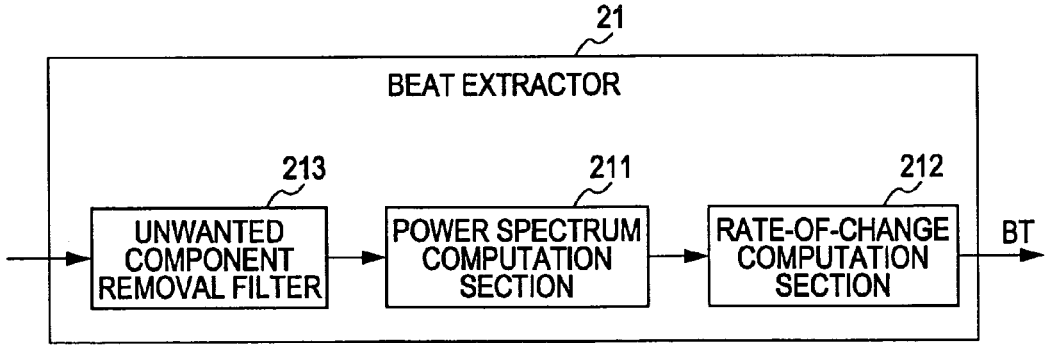
FIG. 12 is a block diagram illustrating another embodiment of the beat extraction apparatus according to the present invention.

For example, as shown in FIG. 12, an unwanted component removal filter 213 for removing components that are assumed comparatively not related to the extraction of beat components, for example, high-frequency components and ultralow-frequency components, is provided at a stage prior to the power spectrum computation section 211. Then, the power spectrum computation section 211 computes the power spectrum of audio data after unwanted components are removed by the unwanted component removal filter 213, and the rate-of-change computation section 212 computes the rate of change of the power spectrum in order to obtain a beat component detection output signal BT.

According to this example of FIG. 12, as a result of the unwanted frequency components being removed, the amount of calculations in the power spectrum computation section 211 can be reduced.

The embodiments of the present invention are not applied to only the personal computer and the portable music playback apparatus described above. Of course, the present invention can be applied to any form of apparatuses or electronic apparatuses as long as a beat of musical data of music content is extracted in real time, rhythm tracking is performed, or applications thereof can be applied.

It should be understood by those skilled in the art that various modifications, combinations, sub-combinations and alterations may occur depending on design requirements and other factors insofar as they are within the scope of the appended claims or the equivalents thereof.

What is claimed is:

1. A rhythm tracking apparatus comprising:

beat extraction means for detecting a change in a portion of a power spectrum in a spectrogram of an input music signal, the change having a magnitude greatest among other changes determined for adjacent portions of the power spectrum, and for outputting a detection output signal that is synchronized in time to the changing portion in synchronization with the input music signal;

tempo value estimation means for detecting a self-correlation of the detection output signal from the beat extraction means and for estimating a tempo value of the input music signal;

a variable frequency oscillator in which an oscillation center frequency is determined on the basis of the tempo value from the tempo value estimation means and a phase of an output oscillation signal is controlled on the basis of a phase control signal;

phase comparison means for comparing the phase of the output oscillation signal from the variable frequency oscillator with the phase of the detection output signal of the beat extraction means and for supplying a resultant comparison error signal as the phase control signal to the variable frequency oscillator; and output means for generating and outputting a beat synchronization signal synchronized with the beat of the input music signal on the basis of the output oscillation signal of the variable frequency oscillator.

2. The rhythm tracking apparatus according to claim 1, wherein the beat extraction means comprises:

power spectrum computation means for computing a power spectrum of the input music signal; and amount-of-change computation means for computing an amount of change of the power spectrum computed by the power spectrum computation means and for outputting the computed amount of change.

3. A music-synchronized display apparatus comprising:

beat extraction means for detecting a change in a portion of a power spectrum in a spectrogram of an input music signal, the change having a magnitude greatest among other changes determined for adjacent portions of the power spectrum, and for outputting a detection output signal that is synchronized in time to the changing portion in synchronization with the input music signal;

tempo value estimation means for detecting a self-correlation of the detection output signal from the beat extraction means and for estimating a tempo value of the input music signal;

a variable frequency oscillator in which an oscillation center frequency is determined on the basis of the tempo value from the tempo value estimation means and a phase of the output oscillation signal is controlled on the basis of a phase control signal;

phase comparison means for comparing the phase of the output oscillation signal from the variable frequency oscillator with the phase of the detection output signal of the beat extraction means and for supplying a resultant comparison error signal as the phase control signal to the variable frequency oscillator;

beat synchronization signal generation and output means for generating and outputting a beat synchronization signal synchronized with the beat of the input music signal on the basis of the output oscillation signal of the variable frequency oscillator;

an attribute information storage section in which attribute information is stored in such a manner as to correspond to the identification information of music content, the attribute information containing at least time-series information of piece-of-music composition information in units of piece-of-music materials of the music content;

attribute information obtaining means for obtaining attribute information of the input music signal from the attribute information storage section; and display information generation means for referring to the time-series information of the attribute information of the input music signal obtained by the attribute information obtaining means in synchronization with the beat synchronization signal from the beat synchronization signal generation and output means, for generating display information to be displayed on a display screen in synchronization with the playback of the input music signal on the basis of the piece-of-music composition information, and for outputting the display information to display means.

4. The music-synchronized display apparatus according to claim 3, wherein the beat extraction means comprises:

power spectrum computation means for computing a power spectrum of the input music signal; and amount-of-change computation means for computing an amount of change of the power spectrum computed by the power spectrum computation means and for outputting the computed amount of change.

5. The music-synchronized display apparatus according to claim 3, wherein the display information to be generated by the display information generation means is lyrics of music content that is made to be the input music signal.

6. A rhythm tracking method comprising the steps of:

extracting a beat by detecting a change in a portion of a power spectrum in a spectrogram of an input music signal, the change having a magnitude greatest among other changes determined for adjacent portions of the power spectrum, and by outputting a detection output signal that is synchronized in time to the changing portion in synchronization with the input music signal;

detecting a self-correlation of the detection output signal output in the beat extraction and estimating a tempo value of the input music signal;

following the beat through phase control by controlling an oscillation center frequency of a variable frequency oscillator on the basis of the tempo value estimated in the tempo value estimation, by comparing the phase of the output oscillation signal from the variable frequency oscillator with the phase of the detection output signal output in the beat extraction, and by supplying a resultant comparison error signal to the variable frequency oscillator; and generating and outputting a beat synchronization signal synchronized with the beat of the input music signal on the basis of the output oscillation signal of the variable frequency oscillator.

7. The rhythm tracking method according to claim 6, wherein the beat extraction comprises the steps of:

computing a power spectrum of the input music signal; and computing an amount of change of the power spectrum computed in the power spectrum computation and outputting the computed amount of change.

8. A music-synchronized display method comprising the steps of:

extracting a beat by detecting a change in a portion of a power spectrum in a spectrogram of an input music signal, the change having a magnitude greatest among other changes determined for adjacent portions of the power spectrum, and by outputting a detection output signal that is synchronized in time to the changing portion in synchronization with the input music signal;

detecting a self-correlation of the detection output signal output in the beat extraction step and estimating a tempo value of the input music signal;

following the beat through phase control by controlling an oscillation center frequency of a variable frequency oscillator on the basis of the tempo value estimated in the tempo value estimation, by comparing a phase of the output oscillation signal from the variable frequency oscillator with the phase of an detection output signal output in the beat extraction, and by supplying a resultant comparison error signal to the variable frequency oscillator;

generating and outputting a beat synchronization signal synchronized with the beat of the input music signal on the basis of the output oscillation signal of the variable frequency oscillator;

obtaining attribute information of the input music signal from an attribute information storage section in which attribute information is stored in such a manner as to correspond to the identification information of music content, the attribute information containing at least time-series information of piece-of-music composition information in units of piece-of-music materials of the music content; and referring to the time-series information of the attribute information of the input music signal obtained in the attribute information obtainment in synchronization with the beat synchronization signal output in beat synchronization signal generation and output, generating display information to be displayed on a display screen in synchronization with the input music signal on the basis of the piece-of-music composition information, and outputting the display information to display means.

9. The music-synchronized display method according to claim 8, wherein the beat extraction comprises the steps of:

computing a power spectrum of the input music signal; and computing an amount of change of the power spectrum computed in the power spectrum computation and outputting the computed amount of change.

10. A rhythm tracking apparatus comprising:

a beat extraction section configured to detect a change in a portion of a power spectrum in a spectrogram of an input music signal, the change having a magnitude greatest among other changes determined for adjacent portions of the power spectrum, and to output a detection output signal that is synchronized in time to the changing portion in synchronization with the input music signal;

a tempo value estimation section configured to detect a self-correlation of the detection output signal from the beat extractor and to estimate a tempo value of the input music signal;

a variable frequency oscillator in which an oscillation center frequency is determined on the basis of the tempo value from the tempo value estimation section and the phase of an output oscillation signal is controlled on the basis of a phase control signal;

a phase comparator configured to compare the phase of the output oscillation signal from the variable frequency oscillator with the phase of the detection output signal of the beat extractor and to supply a resultant comparison error signal as the phase control signal to the variable frequency oscillator; and an output section configured to generate and output a beat synchronization signal synchronized with the beat of the input music signal on the basis of the output oscillation signal of the variable frequency oscillator.

11. A music-synchronized display apparatus comprising:

a beat extractor configured to detect in real time, a change in a portion of a power spectrum in a spectrogram of an input music signal, the change having a magnitude greatest among other changes determined for adjacent portions of the power spectrum, and to output a detection output signal that is synchronized in time to the changing portion in synchronization with the input music signal;

a tempo value estimation section configured to detect a self-correlation of the detection output signal from the beat extractor and to estimate a tempo value of the input music signal;

a variable frequency oscillator in which an oscillation center frequency is determined on the basis of the tempo value from the tempo value estimation section and the phase of the output oscillation signal is controlled on the basis of a phase control signal;

a phase comparator configured to compare the phase of the output oscillation signal from the variable frequency oscillator with a phase of the detection output signal of the beat extractor and to supply a resultant comparison error signal as the phase control signal to the variable frequency oscillator;

a beat synchronization signal generation and output section configured to generate and output a beat synchronization signal synchronized with the beat of the input music signal on the basis of the output oscillation signal of the variable frequency oscillator;

an attribute information storage section in which attribute information is stored in such a manner as to correspond to the identification information of music content, the attribute information containing at least time-series information of piece-of-music composition information in units of piece-of-music materials of the music content;

an attribute information obtaining section configured to obtain attribute information of the input music signal from the attribute information storage section; and a display information generator configured to refer to the time-series information of the attribute information of the input music signal obtained by the attribute information obtaining section in synchronization with the beat synchronization signal from the beat synchronization signal generation and output section, to generate display information to be displayed on a display screen in synchronization with the playback of the input music signal on the basis of the piece-of-music composition information, and to output the display information to a display section.

* * * * *